US007461837B2

(12) United States Patent
Saito et al.

(10) Patent No.: US 7,461,837 B2
(45) Date of Patent: Dec. 9, 2008

(54) SHEET DISCHARGING DEVICE AND SHEET POSTPROCESS APPARATUS USING THE SAME

(76) Inventors: Takashi Saito, 125-1 Mitsukunugi, Sakaigawa-cho, Fuefuki-shi, Yamanashi-ken, 406-0846 (JP); Makoto Shimura, 4437-11 Anayama-cho, Nirashiki-shi, Yamanashi-ken, 407-0263 (JP); Masaya Takahashi, #301 Ekureiru-Shinkai, 3270 Nishiyahata, Kai-shi, Yamanashi-ken, 400-0117 (JP); Yuji Hanawa, 2938 Kamijokitawari, Asahi-cho, Nirasaki-shi, Yamanashi-ken, 407-0044 (JP)

( * ) Notice: Subject to any disclaimer, the term of this patent is extended or adjusted under 35 U.S.C. 154(b) by 240 days.

(21) Appl. No.: 11/373,262

(22) Filed: Mar. 13, 2006

(65) Prior Publication Data

US 2006/0208411 A1 Sep. 21, 2006

(30) Foreign Application Priority Data

Mar. 15, 2005 (JP) ..... 2005-073470
Mar. 15, 2005 (JP) ..... 2005-073471
Mar. 15, 2005 (JP) ..... 2005-073472
Mar. 15, 2005 (JP) ..... 2005-073473

(51) Int. Cl.
*B65H 37/04* (2006.01)

(52) U.S. Cl. ..... 270/58.07; 270/58.08; 270/58.11; 270/58.12; 270/58.27

(58) Field of Classification Search ..... 270/58.07, 270/58.08, 58.11, 58.12, 58.27; 271/220, 271/221
See application file for complete search history.

(56) References Cited

U.S. PATENT DOCUMENTS 5,467,974 A * 11/1995 Ishiwata et al. ..... 271/220
5,639,078 A * 6/1997 Mandel et al. ..... 270/58.12
6,412,774 B1 * 7/2002 Saito et al. ..... 271/220
6,601,846 B2 * 8/2003 Saito et al. ..... 271/226
6,619,648 B2 9/2003 Sasamoto et al.
6,702,279 B2 * 3/2004 Adachi et al. ..... 271/220
2004/0251608 A1 * 12/2004 Saito et al. ..... 271/220

FOREIGN PATENT DOCUMENTS

JP 2002-193515 7/2002
JP 2002-241015 8/2002
JP 2002-241029 8/2002

* cited by examiner

*Primary Examiner*—Gene Crawford
*Assistant Examiner*—Leslie A Nicholson, III
(74) *Attorney, Agent, or Firm*—Manabu Kanesaka

(57) ABSTRACT

A sheet discharging device has a conveying weight for pressing a conveyed sheet to a caterpillar belt. The pressing force of the weight is increased both when the sheet is discharged from the caterpillar belt to a placement tray, and when the sheet is switched back and conveyed to the bottom of the caterpillar belt. The pressing force of the weight is increased concurrently with the driving of a paddle provided at an outlet of the placement tray. The pressing force is increased by a rubber piece provided on a paddle driving shaft that rotates out of phase with the paddle, so as to engage and press the conveying weight at a predetermined time. The device is capable of reliably conveying a wide variety of sheets onto a tray and transferring the conveyed sheets to a predetermined tray position.

13 Claims, 25 Drawing Sheets

SHEET DISCHARGING DEVICE AND SHEET POSTPROCESS APPARATUS USING THE SAME

BACKGROUND OF THE INVENTION AND RELATED ART STATEMENT

The present invention relates to a sheet discharging device that sequentially places sheets on which images are formed using an image forming apparatus such as a printer, copier, or a printing machine, at a predetermined position on a tray, and a sheet postprocess apparatus that executes a postprocess such as stapling, punching, or stamping on the sheets placed on the tray.

To automate a series of processes including copying and printing, postprocess apparatuses are commonly used which temporarily place sheets on which images are formed using an image forming apparatus, on a tray and which then execute a postprocess such as stapling, punching, or stamping on the sheets. The sheets (or a bundle of sheets) postprocessed on the temporary tray are then accommodated in a downstream accumulating tray. When the sheets are thus conveyed to the tray, the correct postprocess can be achieved only if the sheets are orderly transferred to a predetermined position. However, with increases in the speed of the image forming apparatus and in the number of colors used in the apparatus, sheets are more likely to be curled at high temperature. Further, sheets the surfaces of which are coated exert only a small frictional force and are thus difficult to convey. This requires a conveying mechanism that conveys sheets from a sheet discharging port to a predetermined position on the tray.

For example, a conveying belt disclosed in Japanese Patent Laid-Open No. 2002-241015 is known as a mechanism that conveys sheets from the sheet discharging port to the tray. This document describes an endless belt (hereinafter referred to as a caterpillar belt) supported by a pair of pulleys and placed between the sheet discharging port and the tray so that the tray-side pulley can pivot around the sheet discharging port-side pulley in a vertical direction. Accordingly, a sheet from the sheet discharging port is conveyed on a top surface of the belt to the tray. The sheet is then conveyed in the reverse conveying direction by a bottom surface of the belt to abut against a regulating member. When the sheet is switched back on the caterpillar belt and transferred to the predetermined position on the tray, the sheet is reliably conveyed into the tray to prevent incomplete discharging resulting from the trailing end of the sheet remaining at the sheet discharging port. This mechanism is also characterized in that the conveyed sheet can be conveyed to the predetermined position on the tray by the bottom surface of the belt.

When the caterpillar belt is pivotably hung between the sheet discharging port and the tray and moved in the vertical direction depending on the number of sheets loaded on the tray, the following problems may occur. To convey a sheet on the top surface of the belt from the sheet discharging port to the tray, a conveyance guide is required which guides the sheet while sandwiching it between components of the guide. The conveyance guide and the belt conventionally press the sheet by their own weights. Thus, to be conveyed into the tray, the sheet is sandwiched between the conveyance guide and the belt and guided to the tray. After being conveyed into the tray, the sheet is sandwiched between the bottom surface of the belt or the uppermost sheet accumulated on the tray and transferred to the predetermined position. For design conditions for the conveyance guide and belt, it is difficult to set stable conveyance conditions for a wide variety of sheets such as thin paper, which is likely to be curled, and glossy paper, the surface of which is coated.

If the conveyance guide is reduced to allow a sheet to advance more easily between the conveyance guide and the belt top surface, then with thick glossy paper like colored paper, the sheet trailing end may remain on the belt to prevent the sheet from being appropriately discharged. With thin sheets, which are likely to be curled, when a sheet conveyed onto the tray is reversed and guided to the belt bottom surface, the curled sheet trailing end may advance between the belt top surface and the conveyance guide to cause jamming. An increase in the pressing force of the conveyance guide may prevent the curled thin sheet from advancing from the sheet discharging port to the belt top surface, thus causing jamming. Similarly, an increase in the contact force between the belt bottom surface and the tray may exert a stronger conveying force on accumulated sheets to damage them, for example, wrinkle them. In contrast, a decrease in contact force may disadvantageously preclude a sheet advanced onto the tray from being reliably transferred to the predetermined position.

The present invention has been made in view of the above problems. A main object of the present invention is to provide a sheet discharging device with a simple structure which can reliably convey a wide variety of sheets onto a tray by adjusting the magnitudes of the pressing forces of a conveyance guide and a caterpillar belt according to the position of the sheet transferred from a sheet discharging port to a predetermined position on the tray, the sheet discharging device being able to then reliably transfer the conveyed sheet to a predetermined position on the tray, as well as a sheet postprocess apparatus using the sheet discharging device.

The other objects and features of the present invention will be clarified in the description below of an embodiment based on the accompanying drawings.

SUMMARY OF THE INVENTION

The present invention uses a configuration described below in order to accomplish the above object.

A conveying weight is provided which, when a sheet is conveyed onto a placement tray by a caterpillar belt, presses the sheet conveyed to the caterpillar belt. The pressing force of the conveying weight is increased when the sheet is discharged from the caterpillar belt and when the sheet is switched back and conveyed to the bottom of the caterpillar belt. This prevents the sheet from being inappropriately conveyed off the caterpillar belt or to the caterpillar belt after the switchback. The pressing force of the conveying weight is increased concurrently with driving of a paddle provided at an outlet of a placement tray to switch back and then convey the sheet. This eliminates the need for a special driving source. The pressing force of the weight is increased by allowing a rubber piece provided on a paddle driving shaft and rotating out of phase with the paddle, to engage and press the conveying weight at a predetermined time.

The present invention comprises a sheet discharging port from which sheets are sequentially conveyed, a tray provided below the sheet discharging port and on which the sheets are stacked and supported, and switchback transferring means provided between the sheet discharging port and the tray to convey each sheet from the sheet discharging port to the tray and then to reverse a conveying direction of the sheet on the tray to transfer the sheet to a predetermined position. The switchback transferring means comprises a conveying belt provided between the sheet discharging port and the tray and a plate-like guide member placed opposite a belt surface to convey the sheet from the sheet discharging port of the conveying belt to the tray. The conveying belt and the plate-like guide member are arranged so that a tray-side end of each of the conveying belt and plate-like guide member can pivot around its sheet discharging port-side end in a vertical direction. The plate-like guide member comprises pressing force applying means for depressing the guide member toward the conveying belt. The pressing force applying means exerts a pressurizing effect during reverse conveyance in which the switchback transferring means transfers a sheet trailing end on the tray to the predetermined position, to increase a pressure contact force between the plate-like guide member and the conveying belt.

The pressing force applying means is actuated by driving means for paddle conveying means for transferring the sheet on a process tray to the processing position. This may make the time when the paddle conveying means applies a conveying force to the sheet on the process tray, different from the time when pressing force applying means applies a pressing force to the plate-like guide member. The paddle conveying means comprises a first plate-like elastic piece having a base end fixed to a rotating shaft. A leading end of the first plate-like elastic piece is elastically deformed so as to convey the sheet on the process tray. The pressing force applying means comprises a second plate-like elastic piece fixed to the rotating shaft. A leading end of the second plate-like elastic piece abuts against the plate-like guide member and is thus deformed to apply a pressing force.

The present invention comprises switchback transferring means comprising a conveying belt provided between a sheet discharging port and a tray, and a plate-like guide member located opposite a belt surface to convey a sheet from the sheet discharging port of the conveying belt to the tray. The conveying belt and the plate-like guide member are arranged so that a tray-side end of each of the conveying belt and plate-like guide member can pivot around its sheet discharging port-side end in a vertical direction. The plate-like guide member has pressing force applying means for depressing the conveying belt. This reduces the pressing force of the pressing force applying means to convey the sheet onto the belt, while increasing the pressing force to convey the sheet off the belt. The sheet is thus reliably conveyed onto the tray. When the sheet is conveyed into the tray, the belt contacts sheets stacked on the tray under a weak pressing force to avoid damage to the sheets, for example, wrinkles in the sheets. When the sheet is transferred to a predetermined position after being conveyed into the tray, the belt is pressed hard to tightly contact the sheet to reliably guide it to the predetermined position.

Therefore, each sheet on the tray can be reliably conveyed off the belt even if its surface is slippery as in the case of colored paper. Even if the sheet discharged from the belt to the tray is slightly curled, it is guided between the bottom surface of the belt and the tray during switchback. The sheet can thus be reliably conveyed to the predetermined position. According to the present invention, paddle conveying means is provided for reversing the conveying direction of the sheet on the tray, and a driving rotating shaft for the paddle conveying means has a plate-like elastic piece to apply a pressing force to the plate-like guide member. The present invention is thus advantageous in that it is easy to drive and has a simple structure.

BRIEF DESCRIPTION OF THE DRAWINGS

FIG. 3(*b*) is a diagram illustrating that a pressurizing force is applied between the belt transferring means and the pressurizing means;

FIG. 8(*b*) is a diagram showing the positional relationship between the first supporting point and the second supporting point of the sheet pressing means observed when a small number of sheets are stacked;

FIG. 8(*c*) is a diagram showing the positional relationship between the first supporting point and the second supporting point of the sheet pressing means observed when a large number of sheets are stacked;

DETAILED DESCRIPTION OF THE PREFERRED EMBODIMENTS

Figure 1:
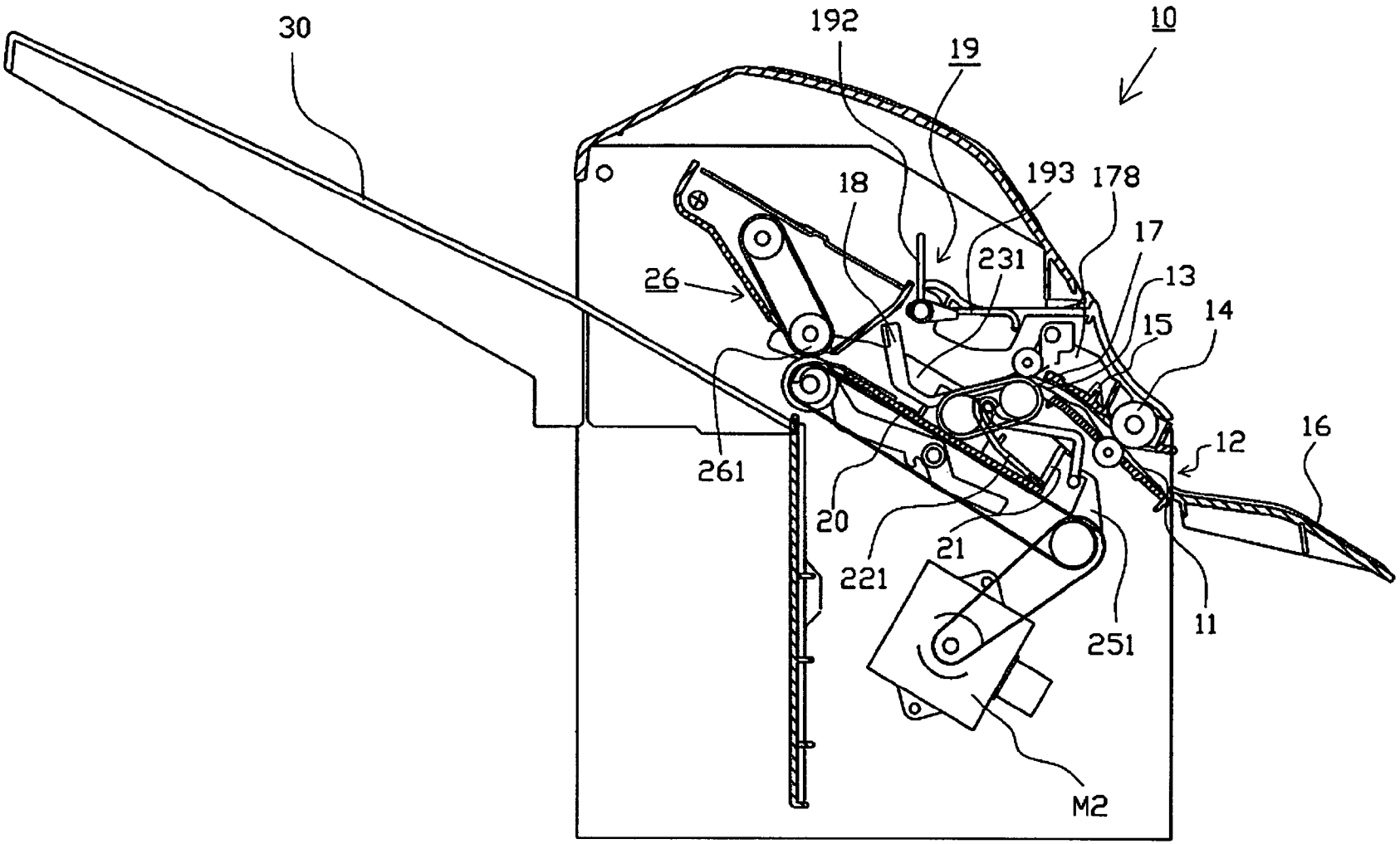
FIG. 1 is a sectional view of an entire postprocess apparatus in accordance with an embodiment of the present invention.
Figure 2:
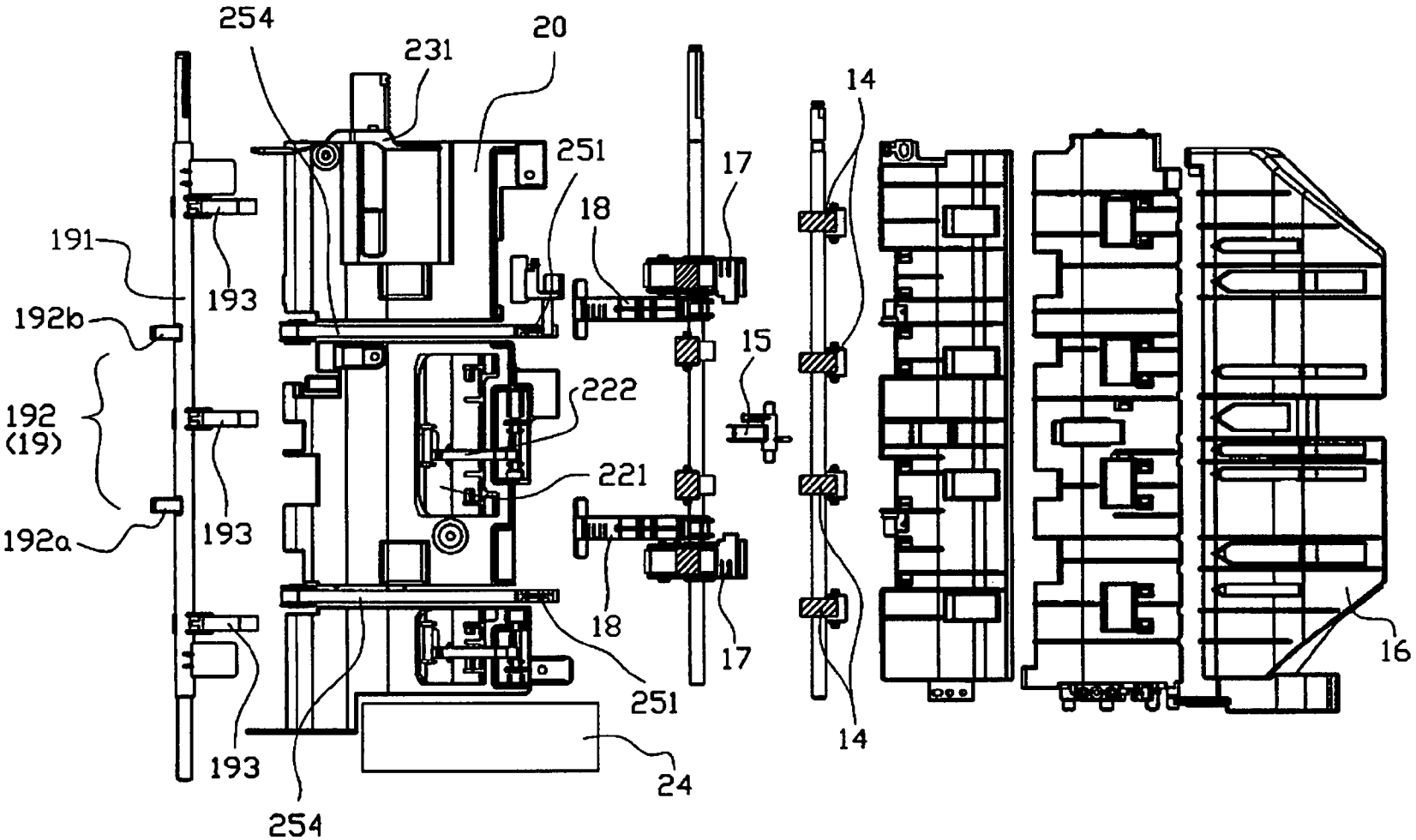
FIG. 2 is a plan view showing the configuration of an essential part of the apparatus shown in FIG. 1.

The present invention will be described below on the basis of an illustrated embodiment. FIG. 1 shows a postprocess apparatus in accordance with the present invention which executes a postprocess such as sheet binding on printed sheets (hereinafter referred to as sheets) formed using an image forming apparatus. Description will be given below of the postprocess apparatus to which the present invention is applied.

Image Forming System

The postprocess apparatus in accordance with the present invention is connected to a sheet discharging port in the image forming apparatus (not shown in the drawings) to sequentially receive sheets on which images have been formed. The postprocess apparatus then executes a "sheet binding process," a "jog process," and a "sheet conveying process" on the received sheets. The image forming system is composed of an image forming apparatus main body comprising a copier, a print function, and a facsimile function, and the postprocess apparatus, connected to the image forming apparatus main body. The image forming apparatus main body is a common apparatus composed of a printer apparatus connected to an external apparatus, for example, a computer. A printing section of the image forming apparatus main body prints sheets fed by a sheet feeding section and a sheet discharging section sequentially conveys the sheets from the image forming apparatus main body. The printing section is composed of a laser head for electrostatic printing, an ink jet head, or an offset print head to print image information on sheets fed by the external apparatus.

A scanner device is integrated into the thus configured printer apparatus to add a copying function or facsimile function to the apparatus, which thus constitutes a multifunctional print system. Such a system comprises, as operation modes, a series of process operations such as a binding process of rearranging and binding sheets on which images have been formed, in the order of pages and a jog process of classifying and housing sheets so that they are rearranged in the order of the pages. Each operation mode is controlled by an operator by setting, in the image forming apparatus, a print mode such as the number of copies or a printing function as well as a postprocess mode such as "sheet binding process," a "jog process," or a "sheet conveying (housing) process." The postprocess apparatus executes a process corresponding to each operation mode in accordance with a command signal from the image forming apparatus.

The postprocess apparatus 10 is composed of a sheet discharging path 11 through which sheets sequentially discharged by the image forming apparatus (not shown in the drawings) are received and conveyed to a downstream process tray 20, the process tray 20 located downstream of a sheet discharging port 13 of the sheet discharging path, and a stacking tray 30 located downstream of the process tray 20. The sheet discharging path 11 has a conveying roller 14 on which sheets fed toward a conveying port 12 are conveyed. The conveying roller 14 is composed of a pair of rollers located in pressure contact with each other. The sheet discharging roller 11 has an inlet sensor 15 that detects a leading and trailing end of a conveyed sheet.

In the figure, reference number 16 denotes a conveyance guide connected to the sheet discharging port in the image forming apparatus to sequentially guide sheets to the conveying port 12 of the sheet discharging path 11. The sheets from the image forming apparatus are thus guided to the sheet discharging path 11 and sequentially fed to the sheet discharging port 13, through which the sheets are further conveyed. The process tray 20 is located below the sheet discharging port 13 so as to form a step. The sheets are temporarily supported on the tray and then subjected to a postprocess. The process tray 20 is integrated with a mechanism corresponding to post process functions executed on the sheets. The illustrated mechanism comprises a "sheet binding function," a "jog function," and a "sheet conveying function" of conveying sheets from the sheet discharging port 13 to the downstream stacking tray 30.

The "sheet binding function" stacks a series of sheets conveyed from the image forming apparatus, on the process tray 20 in the order of pages, staples the sheets, and then houses the processed sheet bundle. The following are thus housed on the process tray 20: a regulating member 21 that regulates a sheet to a reference position, a sheet pressing means 22 for correctly guiding a curled sheet to the regulating means, aligning means 23 for biasing and aligning housed sheets, and staple means (postprocess means) 24 for stapling the registered sheets. The process tray 20 also has sheet push-out means 25 for conveying the stapled sheet bundle to the stacking tray 30. The "jog function" classifies and registers the series of sheets conveyed from the image forming apparatus, on the stacking tray 30 so that they are rearranged in the order of the pages. The process tray 20 thus comprises a shift mechanism that shifts the sheets by a predetermined amount in a direction orthogonal to a conveying direction. The functions of the shift mechanism are provided by the registering means 23. The "sheet conveying function" sequentially conveys the series of sheets conveyed from the image forming apparatus, onto the stacking tray 30 without executing any postprocess on the process tray 20. Eject roller means 26 is thus located on the process tray 20.

Sheet Conveying Mechanism

Figure 3A:
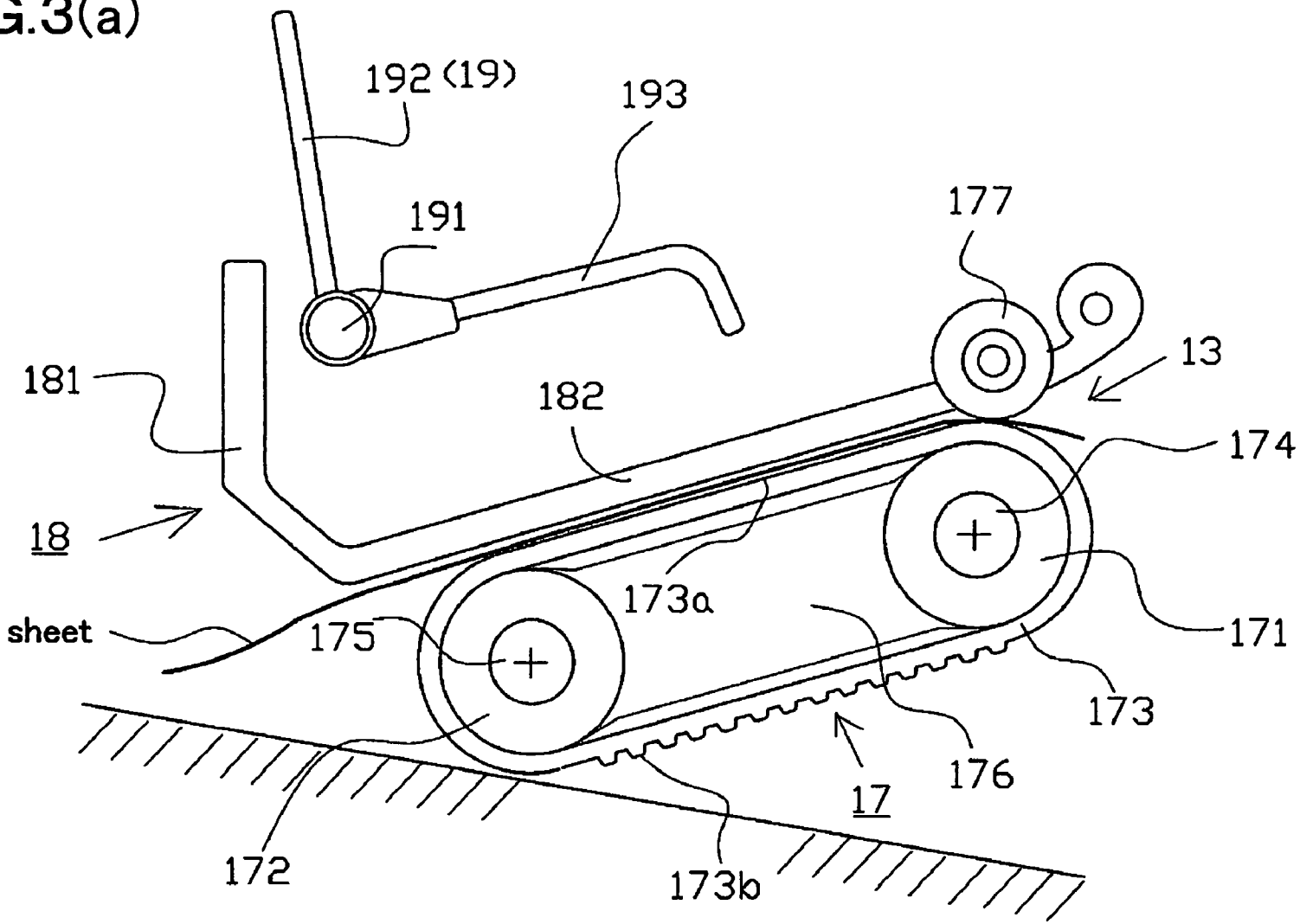
FIG. 3(*a*) is a diagram illustrating that no pressurizing force is applied between belt transferring means and pressurizing means.
Figure 3B:
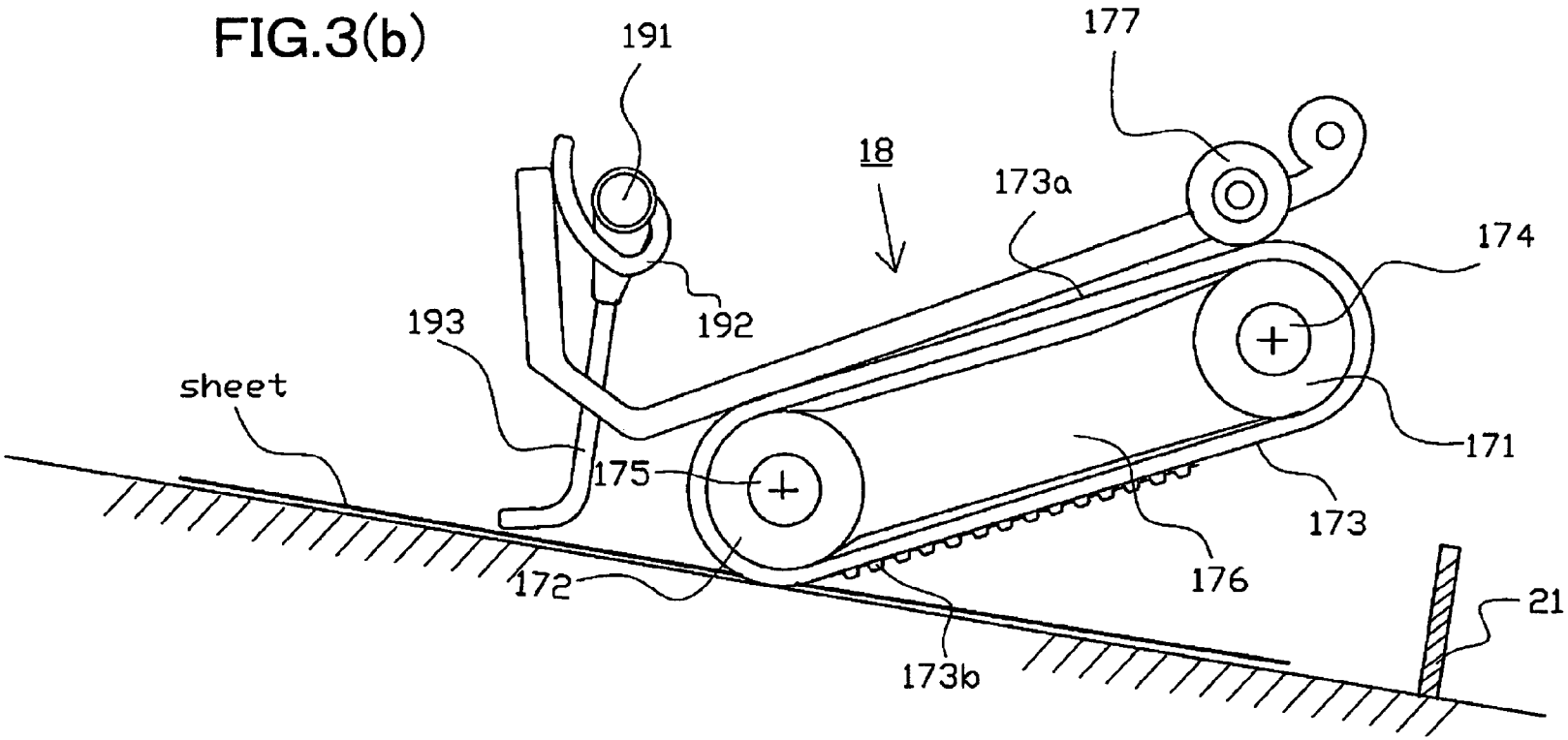

The following conveying mechanisms are provided between the sheet discharging port 13 of the sheet discharging path 11 and the process tray 20: belt transferring means 17 for conveying a sheet from the sheet discharging port 13 to the process tray 20, a plate-like guide member 18 (guide plate described later) that guides the sheet while sandwiching it between the belt transferring means 17 and the plate-like guide member 18, and pressurizing means 19 for conveying the sheet so that its leading end is bolted to a regulating position on the process tray 20. As shown in FIG. 3(*a*), the belt transferring means 17 is composed of a caterpillar belt 173 extended between a pair of pulleys 171 and 172 and is located between the sheet discharging port 13 and the process tray 20 along the sheet conveying direction. The belt transferring means 17 conveys the sheet on an illustrated belt top surface 173*a* to the process tray 20.

A driving motor described later is connected to a shaft 174 of the pulley 171, positioned closer to the sheet discharging port 13. The pulley shaft 174 is turnably borne on an apparatus frame 50 (a side frame of the apparatus is shown). The other pulley 172 of the caterpillar belt 173 is supported around a shaft 175 supported on an arm member 176 integrated with the shaft 174, rotatably supported on the apparatus frame 50. The sheet discharging port-side end of the caterpillar belt 173 is turnably supported on the apparatus frame 50 (side frame). The pulley shaft 175, positioned closer to the process tray 20, is pivotably supported on the arm member 176. A sheet discharging direction leading end (closer to the pulley shaft 175) of the pivotable caterpillar belt 173 in a sheet discharging direction is always in contact with sheets on the process tray 20. An illustrated belt bottom surface 173*b* transfers the uppermost one of the sheets on the process tray 20 in a direction reverse to the sheet discharging direction.

The caterpillar belt 173 consequently transfers a sheet on the belt top surface 173*a* from the sheet discharging port 13 onto the process tray 20 and then uses the belt bottom surface 173*b* to transfer the sheet on the process tray 20 in a direction reverse to the sheet discharging direction. The sheet is thus switched back before being further conveyed. Switchback transferring means is thus composed of the illustrated belt transferring means 17, located between the sheet discharging port 13 and the process tray 20. The caterpillar belt 173 has a pinch roller 177 and the plate-like guide member 18, which are located opposite each other to reliably transfer the sheet from the sheet discharging port 13.

The pinch roller 177 is located closer to the sheet discharging port 13 opposite the caterpillar belt 173 and borne on a paper guide 178 forming the sheet discharging path 11. The plate-like guide member 18 is composed of a guide plate that guides a sheet in the sheet discharging direction. A sheet discharging port-side end of the guide plate 18 is turnably borne on the paper guide 178. A leading end of the guide plate 18 is located along the caterpillar belt 173 in the sheet discharging direction. A sheet from the sheet discharging port 13 is thus nipped between the belt top surface 173*a* of the caterpillar belt 173 and the pinch roller 177. The sheet is then guided to the process tray 20 while being sandwiched between the belt top surface 173*a* and the guide plate 18.

Figure 6:
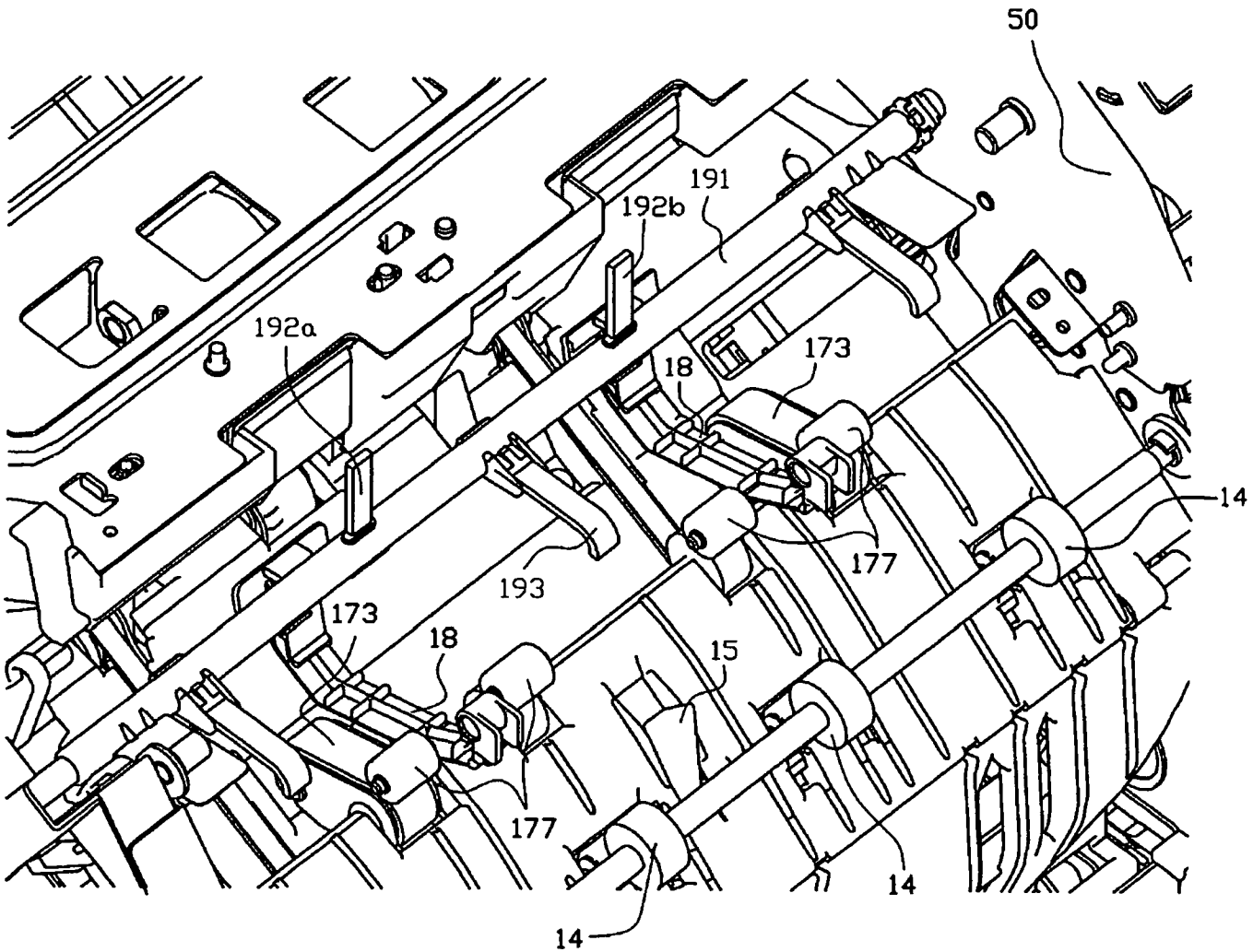
FIG. 6 is a perspective view showing the configuration of pressurizing means.
Figure 7:
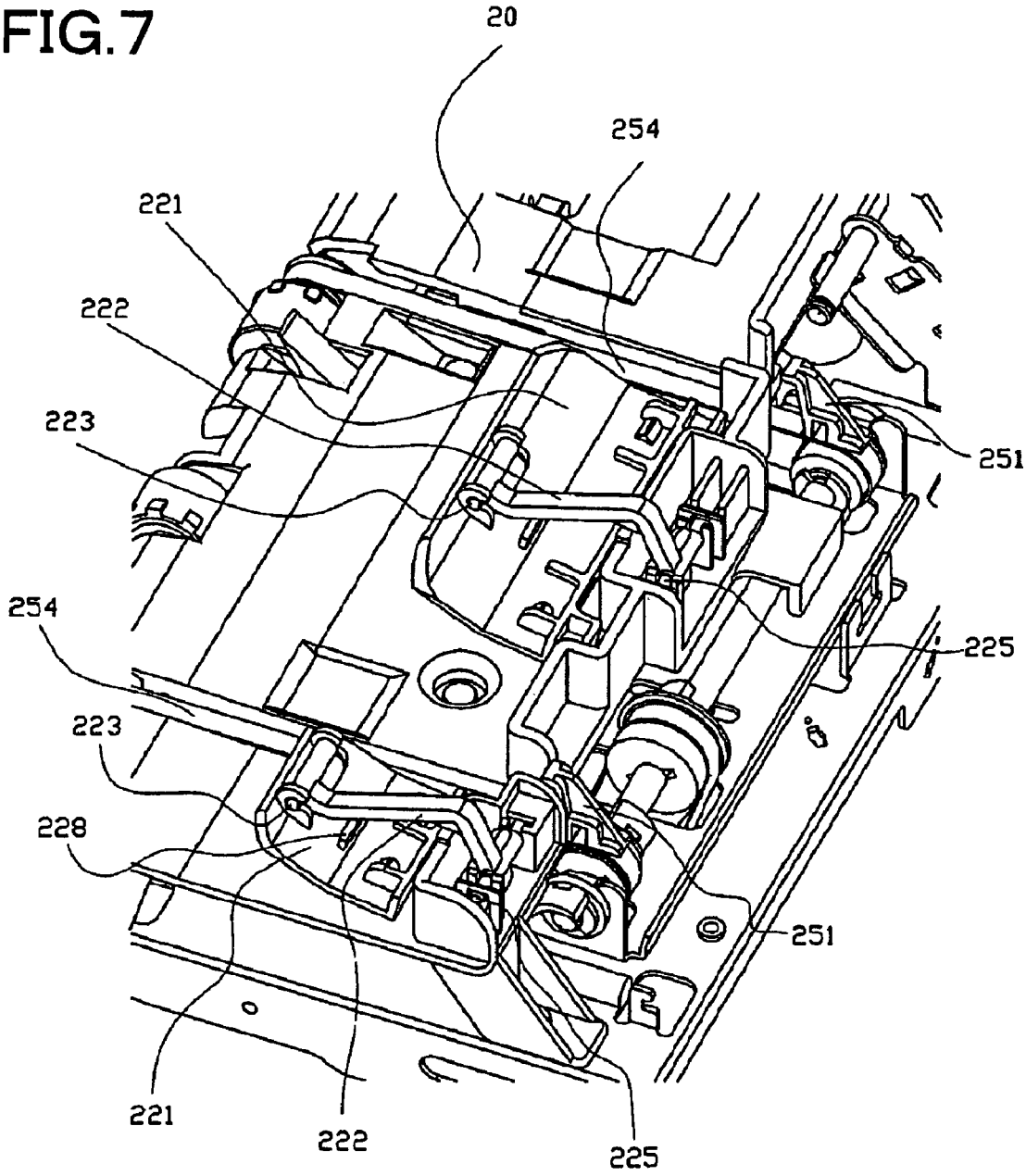
FIG. 7 is a perspective view showing the configuration of sheet pressing means.

A pair of the belt transferring means 17 and a pair of the guide plates 18, described above, are located across the sheet width (in a direction orthogonal to the conveying direction; this applies to the description below) with appropriate spacings between the paired belt transferring means 17 and between the paired guide plates 18 as shown in FIG. 6; the guide plate 18 is positioned the inside the corresponding belt transferring means 17. The guide plate 18 is displaced from the caterpillar belt across the width in order to apply a stronger transferring force to a sheet conveyed on the caterpillar belt 173. The guide plate 18 comprises pressing force applying means described below.

Pressurizing means 19 (paddle piece 193; this applies to the description below) is provided at a leading end of the caterpillar belt in the sheet discharging direction. The pressurizing means 19 is composed of a paddle piece 193 formed of a rubber material and attached to a paddle rotating shaft 191 that is connected to a driving motor described below. The paddle piece 193 rotates counterclockwise in FIG. 3(*a*) so that its leading end transfers a sheet rightward in the figure. The paddle piece 193 comes into contact with a sheet conveyed on the caterpillar belt 173 when the trailing end of the sheet is fed onto the process tray 20. The paddle piece 193 then moves rightward in the figure to advance the sheet between the caterpillar belt 173 and the process tray 20.

As shown in FIG. 6, the paddle rotating shaft 191 has first and second pressurizing elastic pieces 192*a* and 192*b*. A stepping motor is connected to the rotating shaft 191 and has a home position sensor (not shown in the drawings) provided on its driving shaft. When an expected time (timer time) for the sheet trailing end to reach the process tray 20 has passed since the detection of the sheet trailing end by the inlet sensor 15 in the sheet discharging path 11, the paddle piece 193 comes into contact with a sheet on the process tray 20 to move it in the direction (reversal direction) reverse to the conveying direction. The paddle rotating shaft 191 also has a pressurizing elastic piece 192 serving as pressurizing means. The pressurizing elastic piece 192 abuts against a leading end 181 of the guide plate 18 at its leading end to press a guide portion 182 against the belt top surface 173*a*. The caterpillar belt 173 and guide plate 18, previously described, are supported so as to be pivotable around their sheet discharging port 13-side ends. The caterpillar belt 173 and then the guide plate 18 abut against the process tray 20 at their conveying-direction leading ends owing to their own weights.

The pressurizing elastic piece 192 of the paddle rotating shaft 191 applies a pressing force to the guide plate 18. The pressurizing elastic piece 192 presses the guide plate 18 toward the caterpillar belt 173 when the sheet trailing end is conveyed to a predetermined position as in the case of the above paddle piece 193, which starts to rotate at the predetermined time. The pressurizing elastic piece 192 presses the leading end of the caterpillar belt 173 toward the process tray 20. The time when the pressurizing elastic piece 192 pressurizes the guide plate 18 is set so as to establish the following condition: when the leading end of a sheet from the sheet discharging port 13 advances between the guide plate 18 and the caterpillar belt 173, the pressurizing elastic piece 192 is located away from the guide plate 18 and does not apply any pressurizing force. This allows the sheet to advance smoothly between the guide plate 18 and the caterpillar belt 173 (see FIG. 3(*a*)).

Then, immediately before or after the sheet trailing end leaves the leading end of the caterpillar belt 173, the pressurizing elastic piece 193 abuts against the guide plate 18 to depress the guide plate 18 to apply a pressurizing force to it (see FIG. 3(*b*)). With a pressurizing force applied immediately before the leaving of the sheet trailing end, the sheet trailing end reliably receives a conveying force from the caterpillar belt 173 and is thus conveyed onto the process tray 20. This prevents the sheet trailing end from remaining on the caterpillar belt 173. With a pressurizing force applied immediately after the leaving of the sheet trailing end, when the sheet trailing end conveyed onto the process tray 20 is switched back by the paddle piece 192 before being further conveyed, the situation is avoided in which a curled sheet advances between the guide plate 18 and the caterpillar belt 173. The sheet is thus reliably guided to between the process tray 20 and the bottom surface (illustrated belt bottom surface 173*b*) of the caterpillar belt 173.

Components of the Process Tray

The components of the process tray will be described below. The process tray 20 is configured as described below to temporarily stack and support sheets conveyed from the sheet discharging port 13 to the caterpillar belt 173, where the sheets are subjected to a postprocess. First, the illustrated process tray 20 forms a bridge with the stacking tray 30, described later, to support a sheet from the sheet discharging port 13. The process tray 20 is thus configured to be shorter than the conveying direction length of a minimum-sized sheet to be conveyed. The process tray 20 also has the regulating member 21 that positions and regulates the conveying-direction trailing edge of a sheet. The regulating member 21 is composed of a stopper piece projecting from the process tray 20. Accordingly, a sheet conveyed onto the process tray 20 is switched back by having its conveying direction reversed by the paddle piece 192. The sheet is then fed by the belt bottom surface 173*b* until it abuts against the regulating member 21. The sheet then remains stationary. Sheet pressing means 22 is provided on the process tray 20 to press the trailing end of the sheet fed to the regulating member 21.

The sheet pressing means 22 is composed of a plate-like pressing member 221 (hereinafter referred to as a weight plate) that abuts against a top surface of a sheet and an arm member 222 that supports the weight plate 221. The weight plate 221 has its sheet conveying direction upstream side pivotably supported by the arm member 222 via a first supporting shaft 223. The arm member 222 is pivotably supported by a support member 224 such as a frame via a second supporting shaft 225. The arm member 222, supporting the weight plate 221, thus pivots around the second supporting shaft 225 simultaneously with the pivoting of the weight plate 221 around the first supporting shaft 223 as sheets are sequentially stacked on the process tray 20. This allows an almost uniform pressing force to act on a sheet regardless of the number of sheets stacked.

Figure 8A:
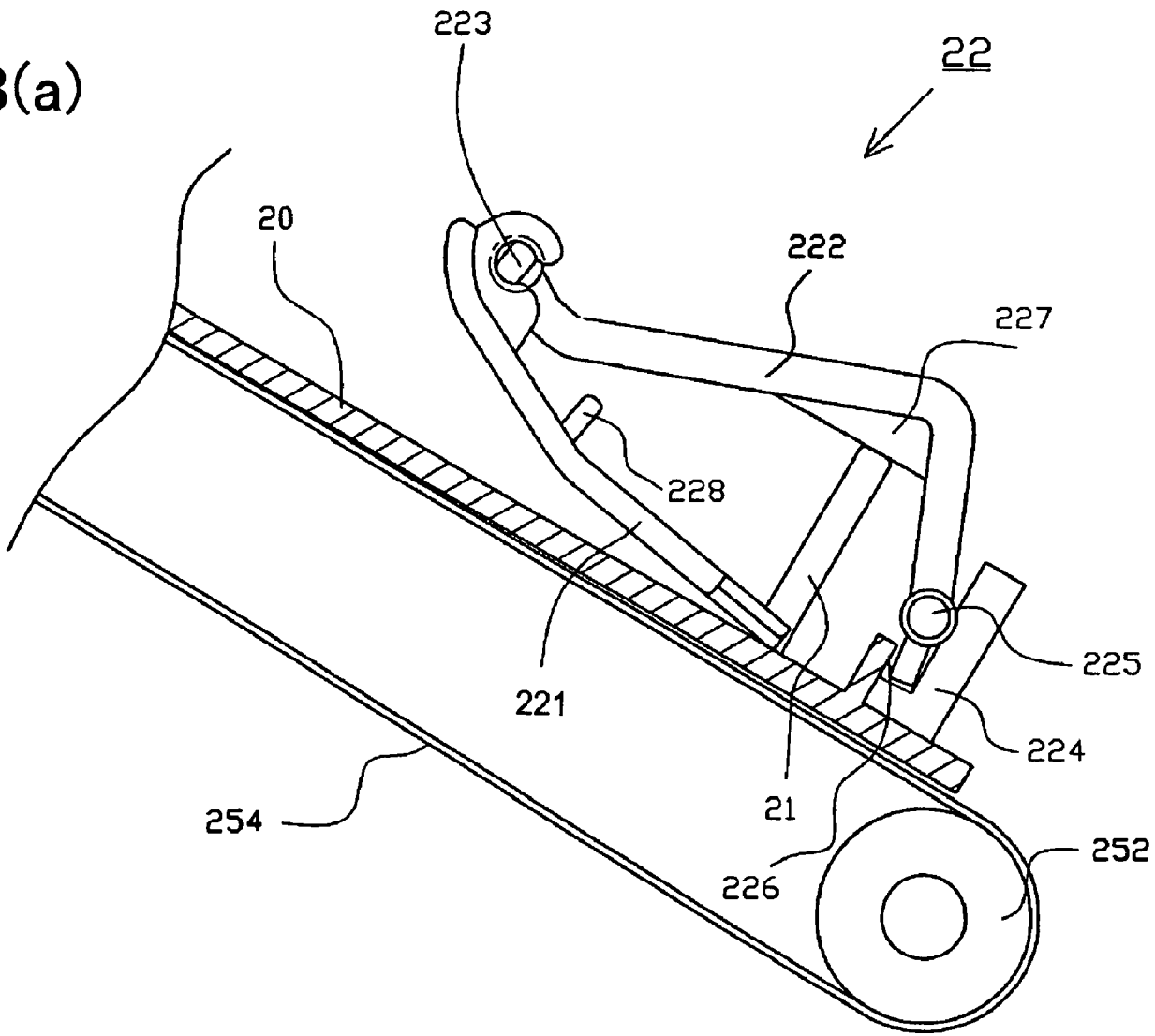
FIG. 8(*a*) is a diagram showing the positional relationship between a first supporting point and a second supporting point of the sheet pressing means observed when there are no sheets.

Consequently, the weight plate 221 and the arm member 222 preferably meet the following conditions. The weight plate 221 is inclined to a placement surface of the process tray 20 so that its upstream side is located above its downstream side (side closer to the regulating member 21). This allows a sheet to advance easily onto the weight plate 221. A sheet with its leading end curled is straightened along the inclined surface of the weight plate 221. The leading end of the illustrated weight 221 crosses the regulating member 21 as shown in FIG. 8(*a*). The regulating member 21, projecting upward from the process tray 20, is partly notched across the sheet width to form a notch portion. A part of the weight plate 221 is fitted into the notch portion so that the weight plate 221 crosses the regulating member 21. This prevents the formation of a gap between the regulating member 21 and the weight plate 221 into which a curled leading end may advance.

The arm member 222 pivotably supports the weight plate 221 via the first supporting shaft 223. The arm member 222 also bears the weight plate 221 on a support member 224 including the apparatus frame via the second supporting shaft 225 so that the rotative supporting point position moves up or down depending on the number of sheets stacked. The positional relationship between the first supporting shaft 223 and the second supporting shaft 225 is set as described below. The second support 225 (hereinafter referred to as the second supporting point) is placed downstream of the first supporting shaft 223 (hereinafter referred to as the first supporting point) in the sheet conveying direction.

The second supporting point 225 is set lower than the maximum height of sheets (maximum number of sheets stacked). When the second supporting point 225 is set higher than a maximum number of sheets stacked, an entering sheet exerts a rotating force acting counterclockwise in FIG. 8(*a*), on the arm member 222 to press the sheet hard to block its entry.

Figure 8B:
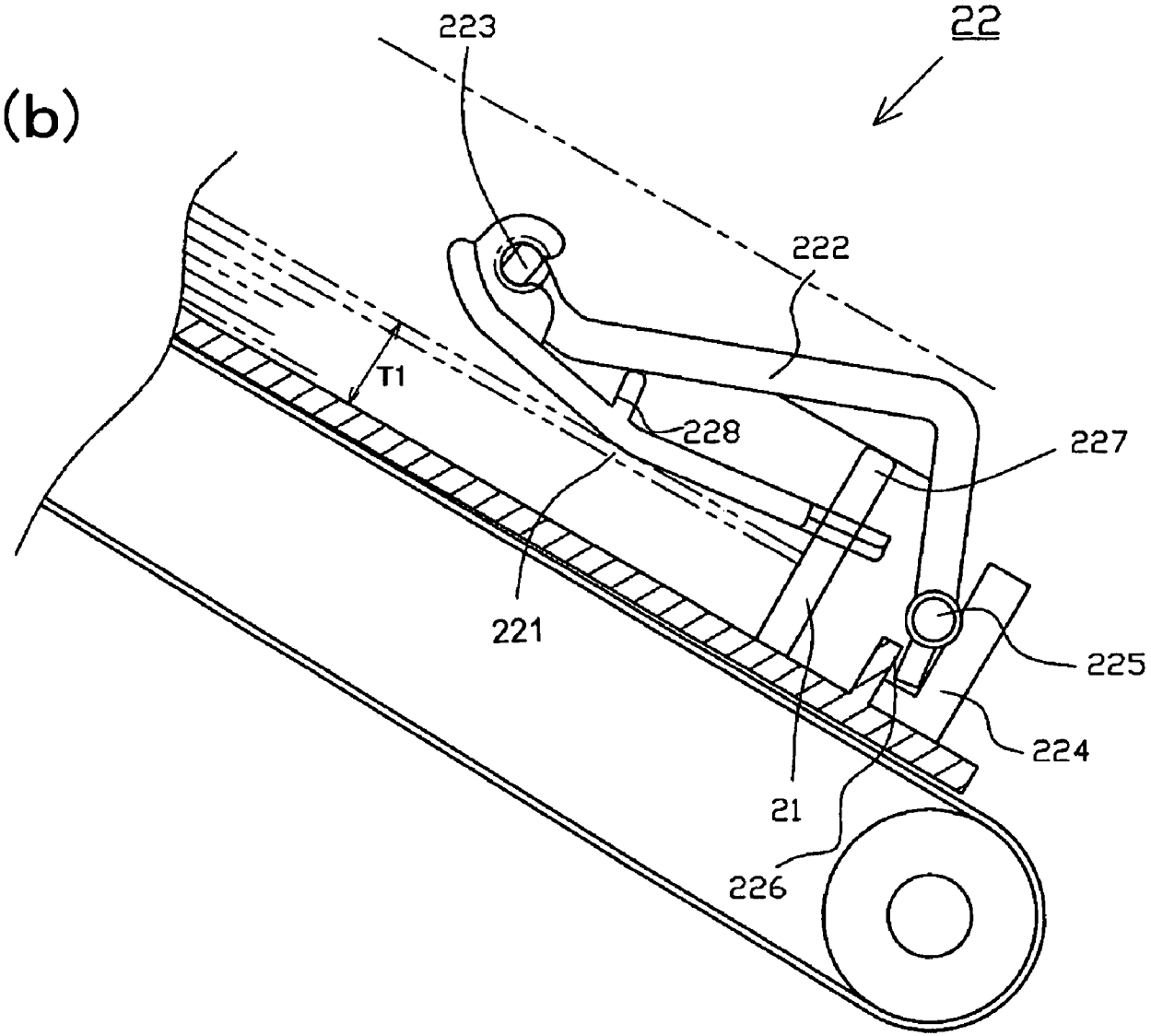
Figure 8C:
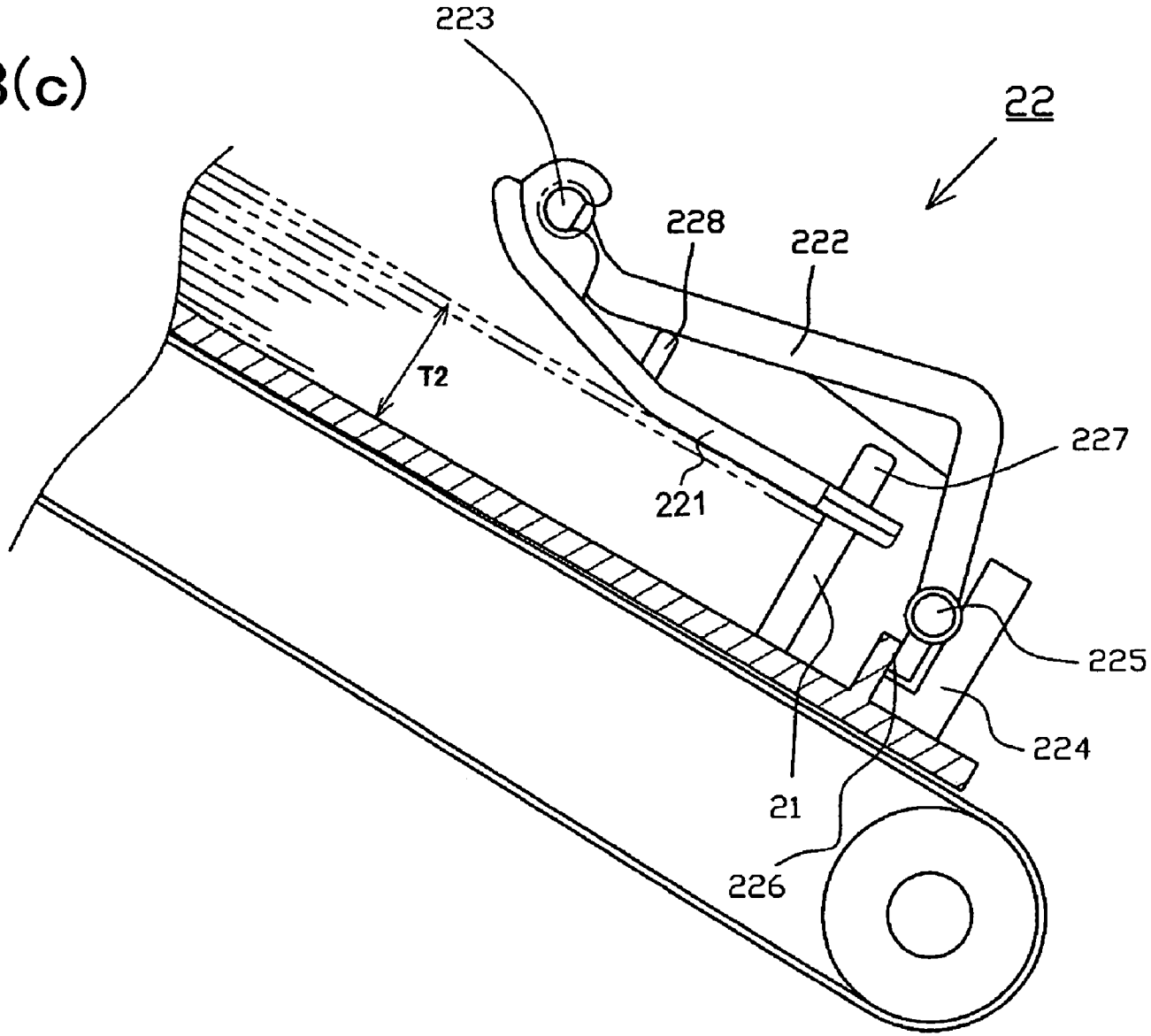

The first supporting point 223 is placed above the second supporting point 225 (closer to the top of FIG. 8(*a*)) on the basis of the sheet placement surface of the process tray 20. Placing the first supporting point 223 at a lower position may result in the exertion, on the arm member 222, of a rotating force acting counterclockwise in FIG. 8(*a*). The weight plate 221 thus comprises the first and second turning supporting points. When only a small number of sheets is stacked on the process tray 20 (T1 shown in FIG. 8*b*), the weight plate 221 pivots around the first supporting point 223. When a large number of sheets are stacked (T2 shown in FIG. 8*c*), the first supporting point position moves around the second supporting point 225. The arm member 222 thus has an upper limit stopper 226 that regulates the upper limit and a lower limit stopper 227 that regulates the lower limit. When the number of sheets stacked is at most a predetermined value (T1 shown in FIG. 8*b*), the lower limit 227 inhibits the turning of the arm member 222, while the upper limit 226 inhibits unwanted turning.

A motion regulating member 228 is provided between the weight plate 221 and the arm member 222 to push up the arm member when the weight plate 221 is pushed up by sheets. The weight plate 221 thus turns counterclockwise around the first support point 223 until sheets are stacked on the process tray 20 up to an illustrated line T1. The weight plate 221 presses sequentially fed sheets. On this occasion, the arm member 222 is locked by the lower limit stopper 227 and thus has its position retained. When the number of sheets stacked sequentially exceeds the value T1, the motion regulating member 228 abuts against the arm member 222 and is then pushed up by a fed sheet. This turns the arm member 222 clockwise in the figure to gradually move the first supporting point 223, the supporting shaft of the weight plate 221. The pivoting motion of the arm member 222 moves the position of the first supporting point 223 as sheets are sequentially fed up to the maximum number of sheets stacked T2. This gradually moves the position of the weight plate 221 up above the process tray 20. The weight plate 221 thus guides a sheet to the regulating member 21 under substantially the same pressing force in the same manner as that in which the weight plate 221 moves up and down depending on the level of sheets on the process tray 20.

Now, the structure of the process tray will be described. The process tray 20 has the regulating member 21, against which the trailing end of a sheet switched back before being further conveyed is abutted. The process tray 20 also has a side regulating member that regulates one of the side edges of the sheets on the tray 20. Although not shown in the drawings, the side regulating member is composed of a flange wall projecting from the process tray 20 toward the reader in FIG. 1. An aligning plate 231 is provided for the other side edge of the sheets; the aligning plate 231 can reciprocate arbitrarily in a direction orthogonal to the sheet conveying direction.

The aligning means 23, composed of the aligning plate 231, biases the sheets placed on the tray toward the side regulating member via the aligning plate 231. Although not shown in the drawings, various well-known structures can be adopted for the biasing mechanism of the aligning plate 231. For example, an aligning plate having an L-shaped cross section is supported on the tray so as to be able to reciprocate. A wire extended across a pair of pulleys is provided on a rear surface (back of the bottom surface) of the tray. The aligning plate is fixed to a part of the wire, and one of the pulleys is connected to a driving motor that can rotate both forward and backward. The forward and backward rotation control of the motor enables the aligning plate to reciprocate across the sheet width, the aligning plate being attached to the wire moving across the sheet width. The process tray 20 has the regulating member 21 for the sheet trailing end and the side regulating member for the one side edge. Postprocess means 24 for sheet binding, stamping, or punching is installed at a predetermined position on the sheets positioned by the regulating members.

Description will be given of a staple device that is a typical sheet-binding postprocess device. A guide groove (not shown in the drawings) is formed in the center of the process tray 20 across the sheet width so that a push-out pawl 251 can move through the guide groove. The push-out pawl 251 transfers a sheet positioned at the downstream regulating member 21 to an upstream eject port 29. A belt member 254 is thus extended between a pair of pulleys 252 and 253 provided on the rear surface of the process tray 20. The push-out pawl 251 is integrally fixed to the belt member 254. A sheet push-out pawl driving motor M2 is connected to the pulley 252. The sheet push-out pawl driving motor M2 moves the push-out pawl 251 along the periphery of the process tray 20. Besides the sheet push-out pawl 251, the eject port 29 has eject roller means 26 of a structure described below.

Figure 5:
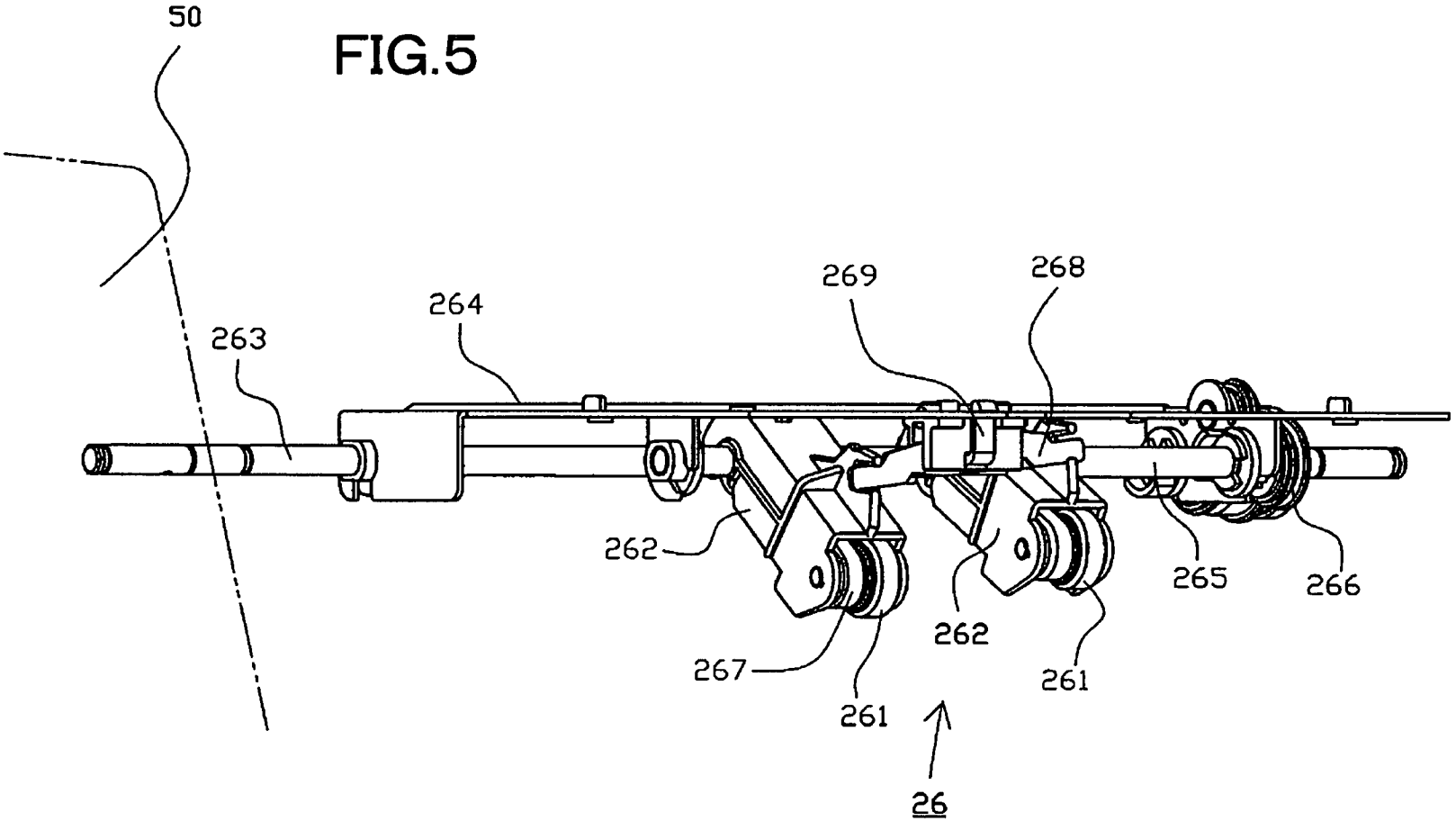
FIG. 5 is a perspective view showing the configuration of an eject roller.

The eject roller means 26 is composed of an eject roller 261 that can arbitrarily come into pressure contact with and separate from the eject port 29 in the process tray 20 and an elevating and lowering support arm 262 that elevates and lowers the roller member. FIG. 5 shows the configuration of the eject roller means 36. A rotating shaft 263 is provided on the apparatus frame. A bracket member 264 is attached to the rotating shaft 263 so as to be pivotable around the rotating shaft 263. The bracket member 264 bears the driving rotating shaft 265 to transmit the rotation of the rotating shaft 263 via a transmission gear 266. The driving rotating shaft 265 pivotably supports a pair of the elevating and lowering support arms 262, each having the eject roller 261 borne at its leading end. A transmission belt 267 is extended between the pulley integrated with the eject roller and the pulley (not shown) provided on the driving rotating shaft 265.

The pair of eject rollers 261 is thus pivotable around the driving rotating shaft 265. The rotation of the driving rotating shaft 265 is transmitted to the eject rollers 261, which thus rotate clockwise (sheet discharging direction) in the figure. A balance arm 268 is thus provided between the paired elevating and lowering support arms 262. The balance arm 268 is joined to the bracket member 264 at its center via a hinge connecting portion 269 so as to be pivotable in a lateral direction. The elevating and lowering support arms 262 are coupled to the respective lateral sides of the balance arm 268; the elevating and lowering support arms 262 are loosely fitted to the balance arm 268 as shown in the figure. Consequently, when the eject rollers 261 attached to the respective elevating and lowering support arms 262 abut partly against the sheet surface on the process tray 20 and are thus tilted, the resulting force tilts the balance arm 268 around the hinge coupling portion 269. The pressing force of the roller acting on the bracket member 264 is then transmitted uniformly to the right and left eject rollers 261.

Stacking Tray

Figure 9:
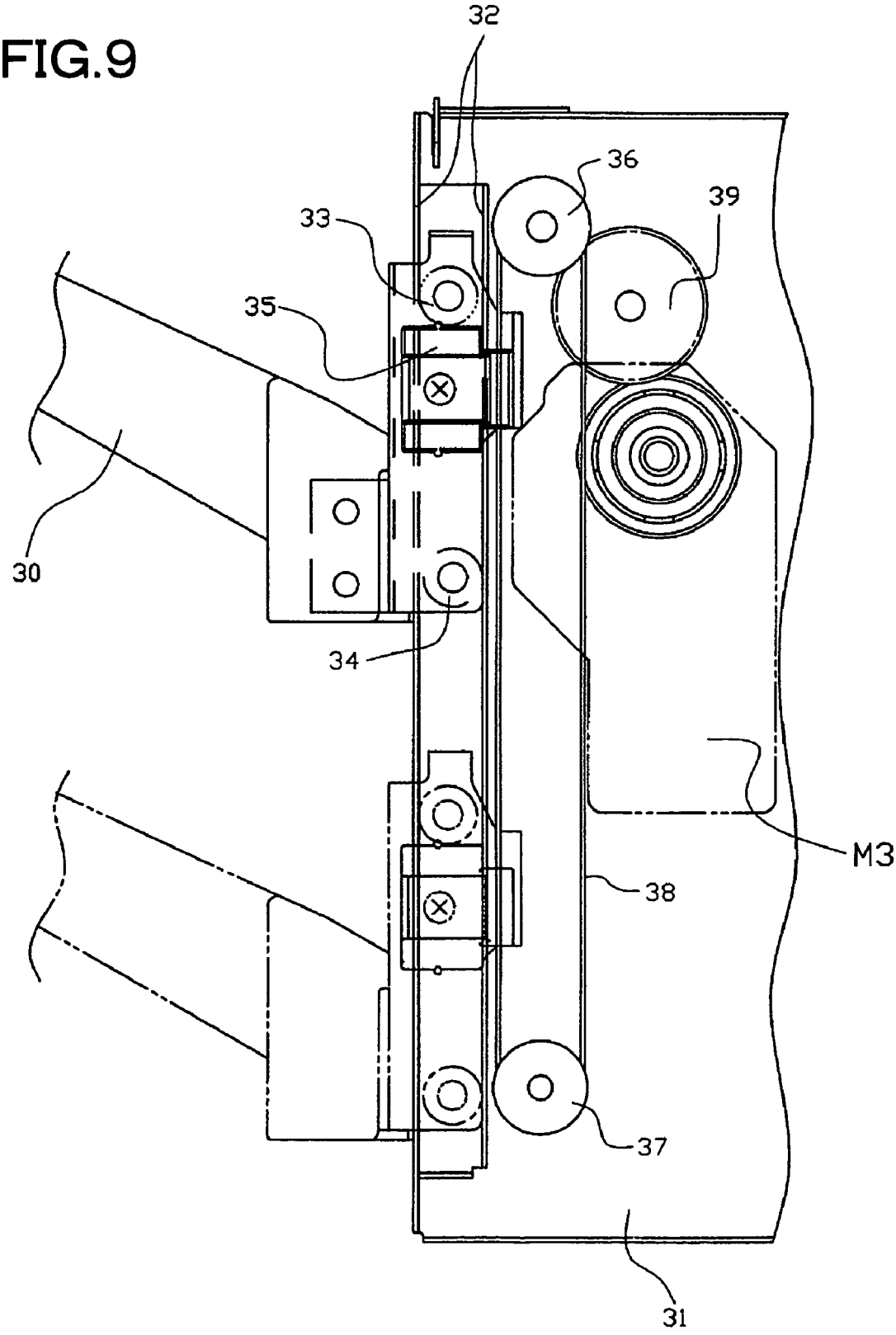
FIG. 9 is a diagram illustrating the structure of a stacking tray.

Description will be given of the structure of the stacking tray 30, located downstream of the process tray 20. As shown in FIG. 9, the stacking tray 30 is attached to an apparatus frame 31 so as to be able to elevate and lower arbitrarily. The stacking tray 30 is controllably elevated and lowered so that the uppermost surface of the stacked sheets is positioned at the eject port 29 of the process tray 20. The apparatus frame 31 has a guide rail 32 extending along a sheet stacking direction. Rollers 33 and 34 fitted on the guide rail 32 are attached to a fixed member 35 of the stacking tray 30.

The stacking tray 30 is thus supported so as to be able to be arbitrarily elevated and lowered along the guide rail 32 by the rollers 33 and 34, integrated with the rollers 33 and 34. The apparatus frame 31 has a vertical pair of pulleys 36 and 37 and an elevating and lowering belt 38 extended between the pulleys 36 and 37. The fixed member 35 is fixed to a part of the elevating and lowering belt 38. An elevating and lowering motor M3 is connected to one of the pulleys 36 and 37 via a transmission gear 39. The elevating and lowering motor M3 drivingly elevates and lowers the stacking tray 30 in the vertical direction of the figure.

An upper limit sensor (not shown in the drawings) is mounted above the stacking tray 30. The elevating and lowering motor M3 gradually lowers the stacking tray 30 depending on the number of sheets stacked so that the uppermost sheet on the stacking tray 30 lies at the upper limit sensor position. When a sheet is removed from the stacking tray 30, the tray top surface is elevated to the upper limit sensor position. In the present invention, the stacking tray 30 may be fixed to the apparatus frame 31 without being elevated or lowered as shown in the figure.

Conveyance Driving System

Figure 4:
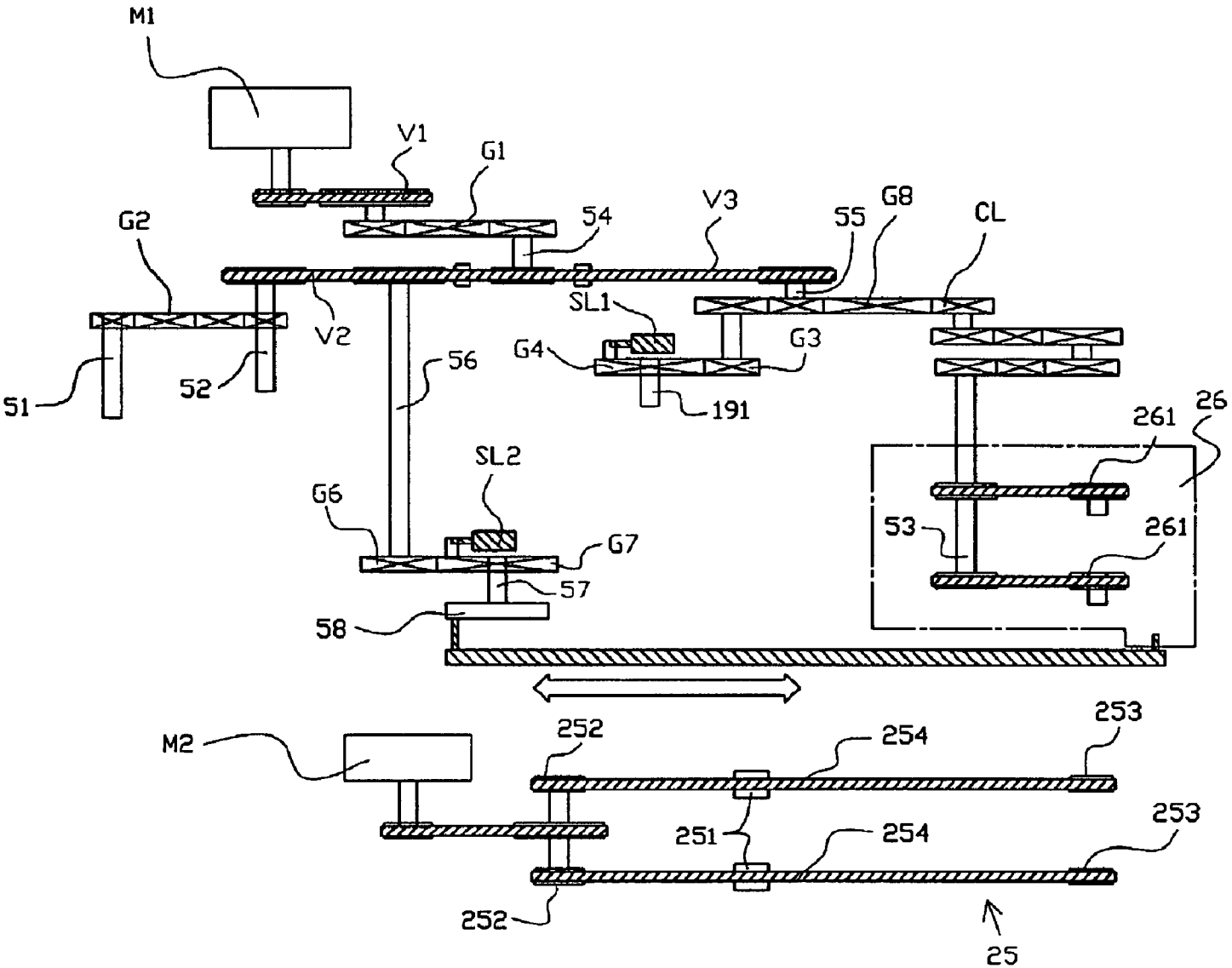
FIG. 4 is a diagram showing the configuration of a conveyance driving mechanism of the apparatus shown in FIG. 1.

Now, a conveyance driving mechanism will be described with reference to FIG. 4. Sheets from the image forming apparatus are stacked on the process tray 20 by the conveying roller 14, caterpillar belt 17, and pressurizing means (paddle) 19, located in the sheet discharging path 11. The sheets are subjected to a postprocess and are then conveyed from the process tray 20 and stacked on the stacking tray 30 by the sheet push-out means 25 and eject roller means 26. These conveying means are driven by the conveyance driving motor M1 or the sheet push-out pawl driving motor M2. The conveyance driving motor M1 rotates in only one direction to drivingly rotate a rotating shaft 51 of the conveying roller 14, a rotating shaft 52 of the caterpillar belt 17, and a rotating shaft 53 of the eject roller 261 in only one direction during every operation.

The conveyance driving motor M1 thus rotates the intermediate rotating shaft 54 via a transmission belt V1 and a transmission gear G1. The intermediate rotating shaft 54 transmits driving to the rotating shaft 52 of the caterpillar belt 17 and the rotating shaft 53 of the eject roller 61 via transmission belts V2 and V3. The rotation of driving shaft 52 of the caterpillar belt 17 is transmitted to the rotating shaft 51 of the conveying roller 14 via a transmission gear G2. This rotates the conveying roller 14, caterpillar belt 17, and eject roller 261 in the sheet conveying direction at a speed set by the transmission belts and transmission gear. The conveyance driving motor M1 transmits driving to the rotating shaft 191 of the pressurizing means 19 via the intermediate rotating shaft 54. Illustrated transmission gears G3 and G4 are connected as described below and the rotation of the transmission gear G3 is transmitted to the transmission gear G4 at a predetermined time.

The transmission gear G4 is composed of a tooth missing gear and comprises a tooth missing portion to which the rotation of the transmission gear G3 is not transmitted. The transmission gear G4 thus has an urging spring that applies an urging force in a direction in which it engages with the transmission gear G3. The transmission gear G4 is held, by a solenoid SL1, at a position where it does not engage with the transmission gear G3. That is, the transmission gears G3 and G4 are held and locked at the non-engagement position, and an unlocking operation of the solenoid SL1 moves the transmission gear G4, under the force of the urging spring, to a position where it engages with the transmission gear G3. The transmission gear G4 subsequently engages with the transmission gear G3 and rotates once. The transmission gear G4 is then disengaged from the transmission gear G3 at the tooth missing portion. The transmission gear G4 is then held at the non-engagement portion by a pawl of the solenoid SL1.

The transmission gear thus transmits only one rotation of the transmission gear G3 to the rotating shaft of the pressurizing means 19 under the action of the solenoid SL1. The solenoid SL1 is set so that on the basis of a signal given by the inlet sensor 15 in the sheet discharging path 11 and indicating detection of the trailing end of a sheet from the caterpillar belt 17, the pressurizing elastic piece 193 presses the guide plate 18 immediately before the sheet trailing end reaches the process tray 20 and so that after the sheet trailing end reaches the process tray 20, the paddle piece 192 engages with the sheet trailing end. To elevate or lower the eject roller 261, the transmission belt V2 rotates to transmit a rotating force to the elevating and lowering support arms 262 of the eject rollers 261 as described below. The elevating and lowering support arms 262 are connected via gears G6 and G7 to the rotating shaft 56, rotated by the transmission belt V2. The transmission gear G7 is composed of a tooth missing gear and provided with an urging spring (not shown) and a solenoid valve SL2 like the gear G4.

Only one rotation of the rotating shaft 56 is transmitted to the rotating shaft 57 at a predetermined time under the action of the solenoid SL2. The rotation of the rotating shaft 57 is transmitted via a cam 58 to the elevating and lowering support arms 262, supporting the eject rollers 261. The cam 58 elevates and lowers the elevating and lowering support arms 262 between a withdrawn position, a standby position, and an operative position shown in FIG. 10. Although not shown in the drawings, the cam 58 is composed of, for example, an eccentric cam and its cam follower is composed of a slide lever that slides in the vertical direction. The slide lever is engaged with the elevating and lowering support arms 262. The rotation of the driving motor M1 is transmitted to the elevating and lowering support arms 262 via the cam 58 to lower the eject rollers 261 by a predetermined amount from the withdrawn position. The motor is then stopped to stop and hold the elevating and lowering support arms 262 at the standby position. The driving motor M1 is then drivingly rotated again to move the elevating and lowering support arms 262 to the operative position where the eject rollers 261 contact the sheet.

In the above configuration, the rotation of the driving motor M1 rotates the conveying roller 14 and caterpillar belt 17 to convey a sheet from the sheet discharging path 11 onto the process tray 20. On the other hand, upon reception of a signal from the control means which instructs a postprocess to be executed on the sheets on the process tray 20, the solenoid SL2 performs an unlocking operation to establish an on-engagement state. The fan-shaped gear G7 rotates in response to the rotation of the driving motor M1, thus rotating the cam 58. The rotation of the cam 58 gradually lowers the elevating and lowering support arms 262 of the eject rollers 261 from the withdrawn position. The driving motor M1 is stopped when the driving motor M1 has rotated by a predetermined amount since the unlocking operation of the solenoid SL2.

Figure 10:
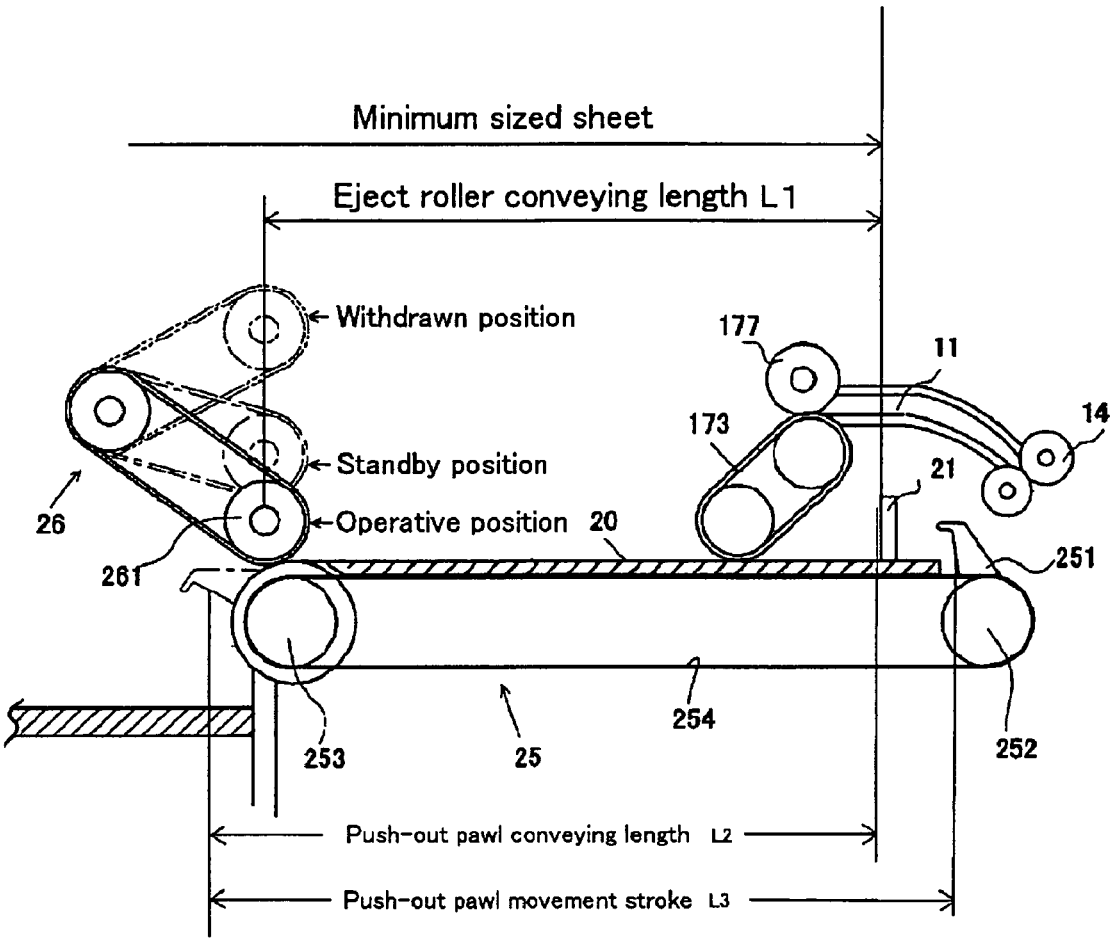
FIG. 10 is a diagram showing the positional relationship between an eject roller and a push-out pawl.

The elevating and lowering support arms 262 then locate and stop the eject rollers 261 at the standby position shown in FIG. 10. The eject rollers 261 are thus stopped between the withdrawn and operative positions to stand by, thus preventing the entry of the user's hand or finger or foreign matter while a postprocess such as stapling is being executed on the sheets on the tray. This also shuts out noise resulting from the staple operation.

Then, upon receiving a signal from the postprocess apparatus which instructs the operation to be finished, the control means actuates the driving motor M1 again. The driving of the driving motor M1 causes the elevating and lowering support arms 262 to locate the eject rollers 261 at the operative position where they abut against the sheets. In the illustrated configuration, the weight of the eject roller means 26 serves to apply a pressing force to abut the eject roller means 26 against the sheets. Operational timings for the elevating and lowering support arms 262 will be described later. Reference characters CL in the figure denote a one-way clutch provided between the rotating shaft 53 and a gear G8 that transmits the driving of the transmission belt V3. The elevating and lowering support arms 262, supporting the eject rollers 261, rotate around the rotating shaft 53. This allows the user to manually elevate the elevating and lowering support arms 262 if trouble such as jamming occurs while the eject rollers 261 are conveying a sheet.

The sheet push-out means 25 is driven as described below, by the sheet push-out pawl driving motor M2, which can rotate both forward and backward. The sheet push-out means 25 is composed of the push-out pawl 251, integrally connected to the belt member 254 extended between the pair of pulleys. The push-out pawl 251 reciprocates along the process tray 20. The sheet push-out pawl driving motor M2 is connected to one 252 of the pulleys.

Description will be given of arrangements that are characteristic of the illustrated and described embodiment. First, with reference to FIG. 10, description will be given of the positional relationship between the sheet push-out means 25 and the eject roller means 26, which are arranged on the process tray 20. The distance (L1 in the figure) between the regulating member 21 and the eject rollers 261 on the process tray 20 is set shorter than the conveying direction length of a minimum-sized sheet. An illustrated push-out pawl conveying length (L2 in the figure) is set so that L2≧L1 in order that the push-out pawl 251 of the sheet push-out means 25 may engage with and push out a sheet from the regulating member 21 to eject rollers 261 on the process tray 20. The movement stroke (L3 in the figure) of the push-out pawl 251 is set so that L3>L2≧L1.

Another characteristic arrangement is the pressurizing means 19, provided in the belt transferring means 17 and shown in FIGS. 3(*a*) and 3(*b*) in detail. The guide portion 182 of the guide plate 18, the base end of which is supported so as to be pivotable, abuts against the belt top surface 173*a* of the caterpillar belt 173 owing to its own weight as shown in FIG. 3(*a*). Under these conditions, a sheet conveyed from the sheet discharging port 13 is nipped between the pinch roller 177 and the caterpillar belt 173 and transferred leftward in the figure. On this occasion, if a sheet guided on the belt top surface 173*a* is thin paper, the guide plate 18 prevents the sheet from being curled or having its leading end flying over the belt top surface 173*a*. For a thick sheet, the guide plate 18 is pushed up by the sheet leading end to facilitate passage of the sheet.

With this configuration, immediately before the sheet leading end leaves the guide plate as shown in FIG. 3(*b*), the pressurizing means 19 presses the guide plate 18 hard against the top surface 173*a* of the caterpillar belt 173. The pressurizing elastic piece 192, provided on the paddle rotating shaft 191 of the pressurizing means 19, presses the leading end 181 of the guide plate 18 through elastic deformation. The sheet is then subjected to a strong conveying force from the caterpillar belt 173 and thus reliably conveyed onto the process belt 20. When reversed and conveyed (rightward in the figure) by the paddle conveying piece 193, the sheet is prevented from advancing between the belt top surface 173*a* and the guide plate 18 even if its leading end is curled. When the sheet leading end is conveyed to between the belt bottom surface 173*b* and the process tray 20, the pressurizing means 19 presses the caterpillar belt 173 to apply a strong conveying force to the sheet leading end.

Another characteristic arrangement is the sheet pressing means 22, which guides a sheet conveyed after being abutted against the regulating member 21 on the process tray 20. This is shown in FIGS. 8(*a*), 8(*b*), and 8(*c*). When only a small number of sheets are stacked on the process tray 20 as shown in FIG. 8(*a*), the sheet pressing means 22 configured as previously described is pivoted counterclockwise around the first supporting point 223 by an entering sheet, to guide it to the regulating member 21 while pressing it. On this occasion, the arm member 222 maintains its position under the action of the lower limit stopper 227. This enables even a sheet with a curled trailing end to be regulated by reliably abutting it against the regulating member 21.

When at least a predetermined number of sheets is stacked on the process tray 20, the motion regulating means 228 of the sheet push-out means 22 engages with the arm member 222 of the sheet push-out means 22 as shown in FIG. 8(*b*). Then, as shown in FIG. 8(*c*), the sheet pressing means 22 is pivoted clockwise in the figure around the second supporting point 225 by an entering sheet, with the first supporting point 223 moved upward. Consequently, even with a variation in the number of sheets stacked, the sheet pressing means 22 maintains substantially the same state (position) and pressing force in guiding a sheet.

Figure 11:
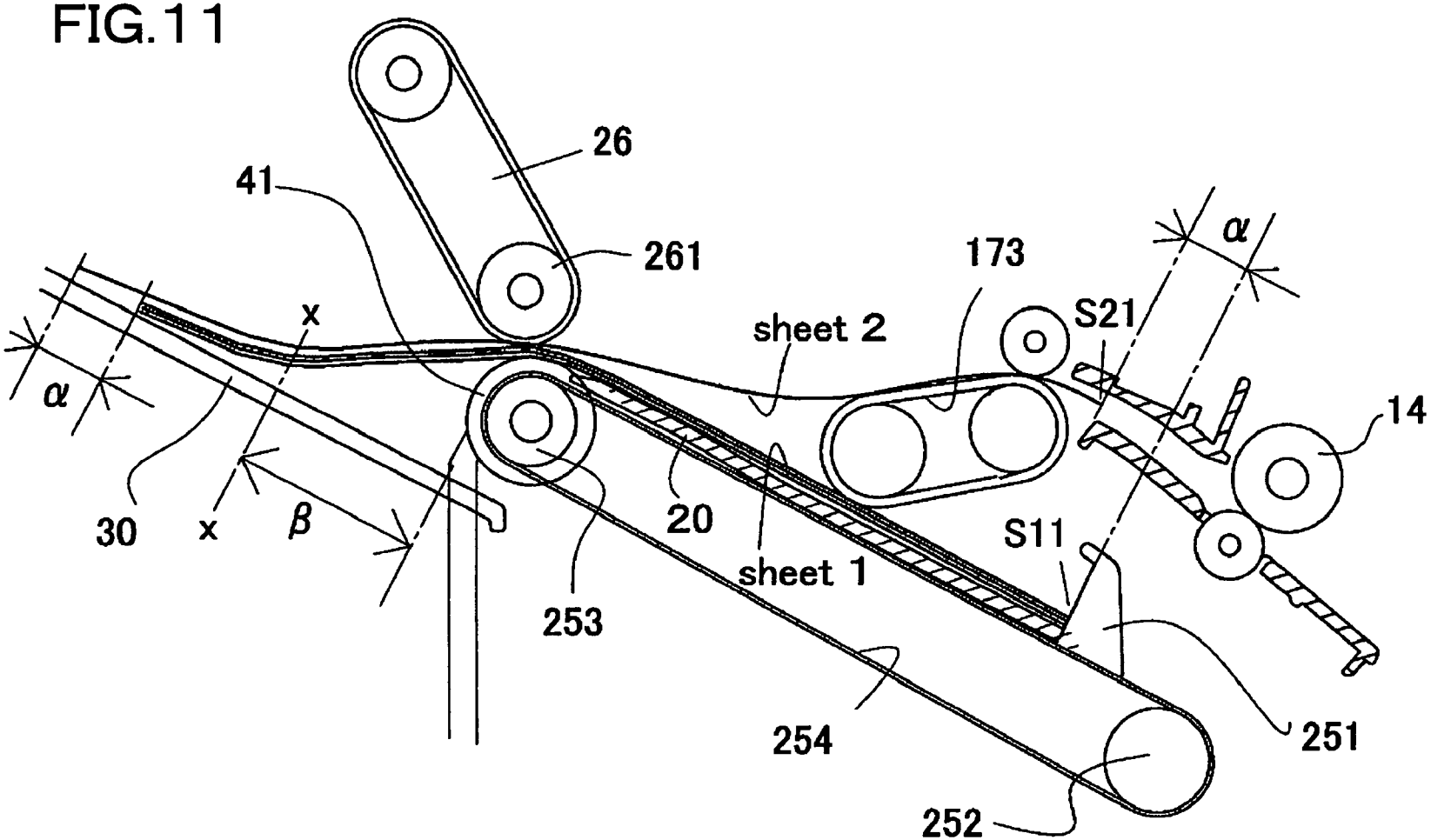
FIG. 11 is a diagram showing the positional relationship between a sheet and a succeeding sheet.
Figure 12A:
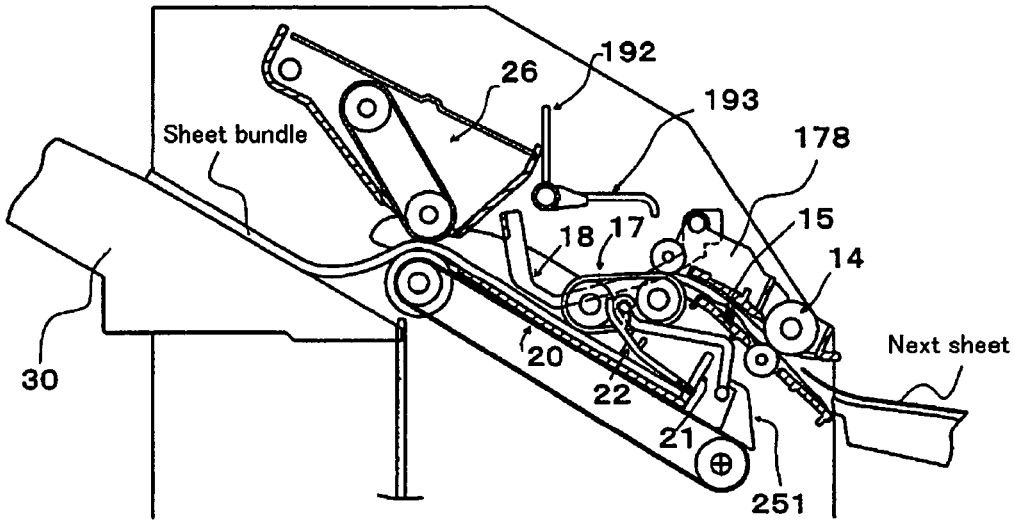
FIGS. 12(*a*) to 12(*n*) are diagrams illustrating the flow of operations performed by the postprocess apparatus in a "sheet binding mode"
Figure 12B:
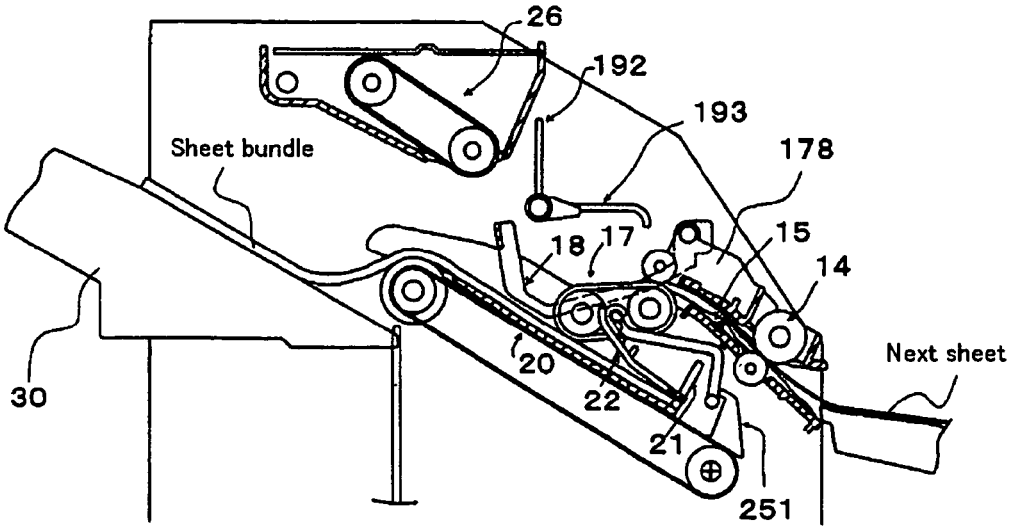
Figure 12C:
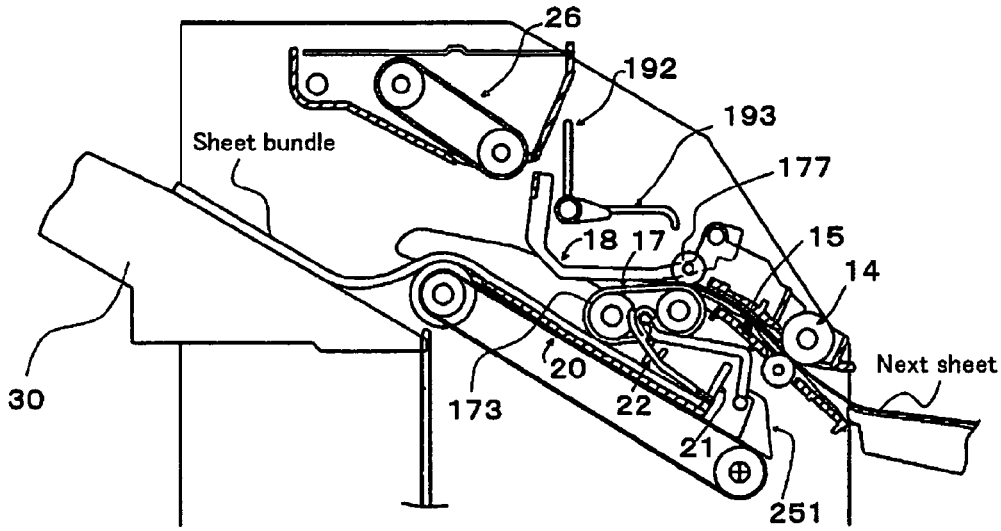
Figure 12D:
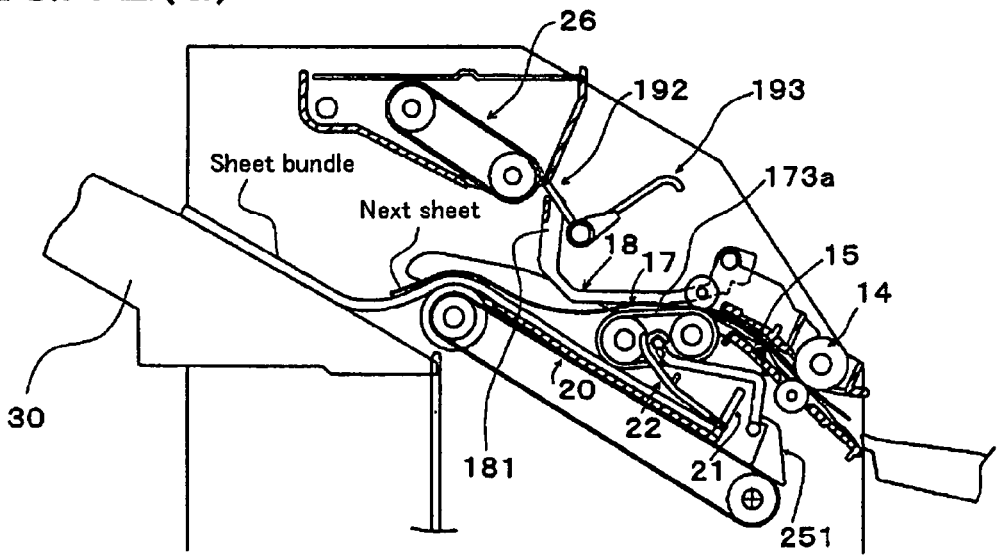
Figure 12E:
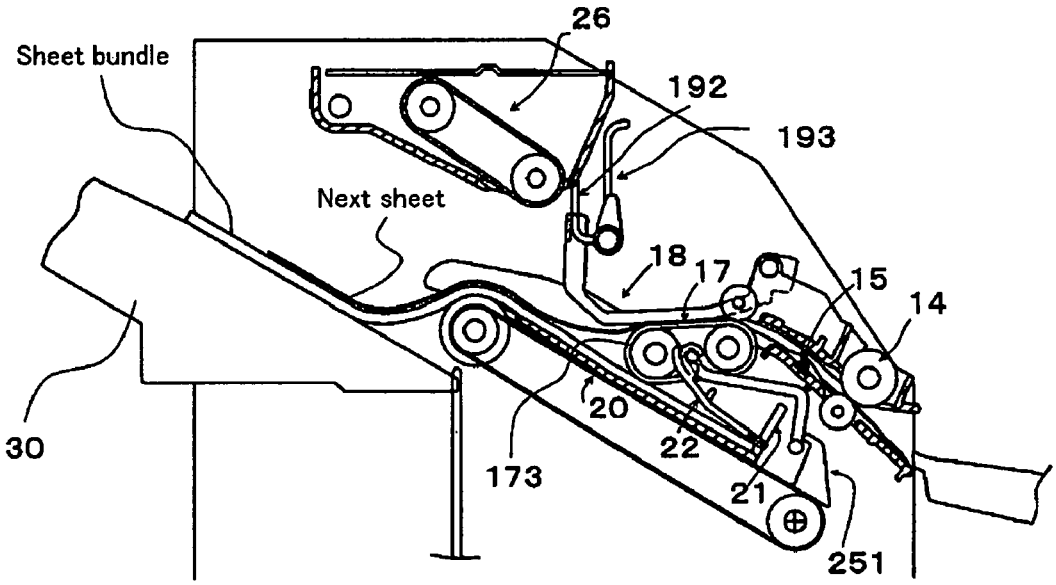
Figure 12F:
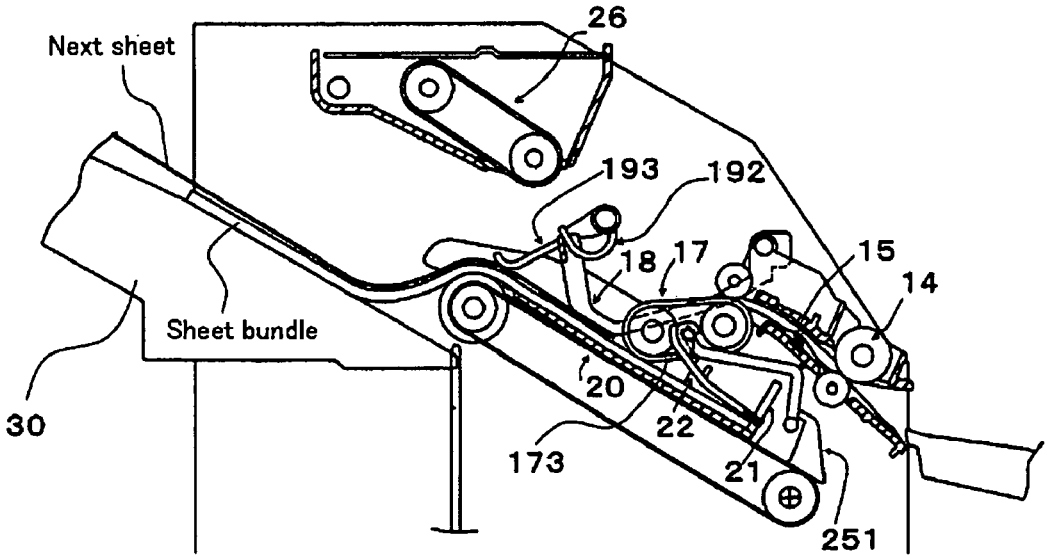
Figure 12G:
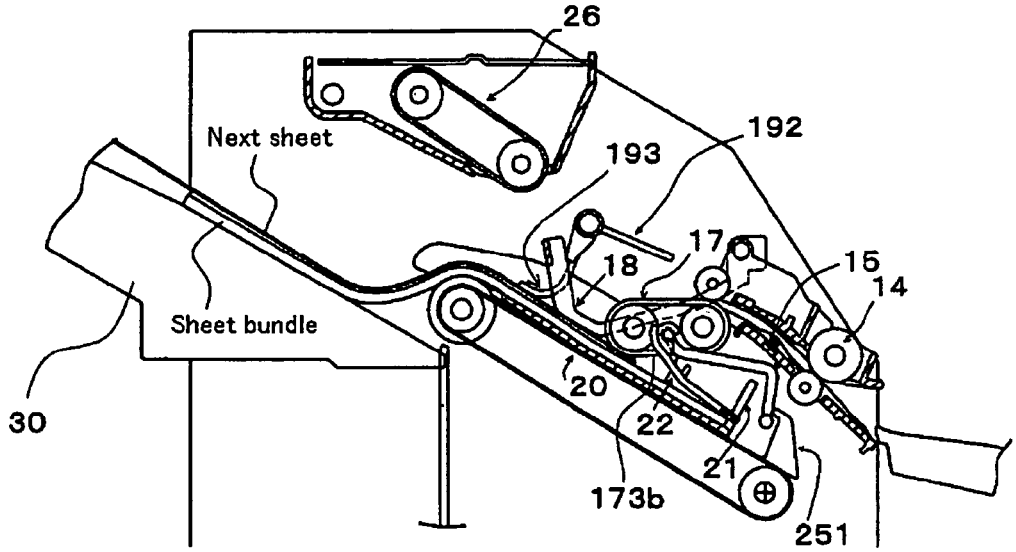
Figure 12H:
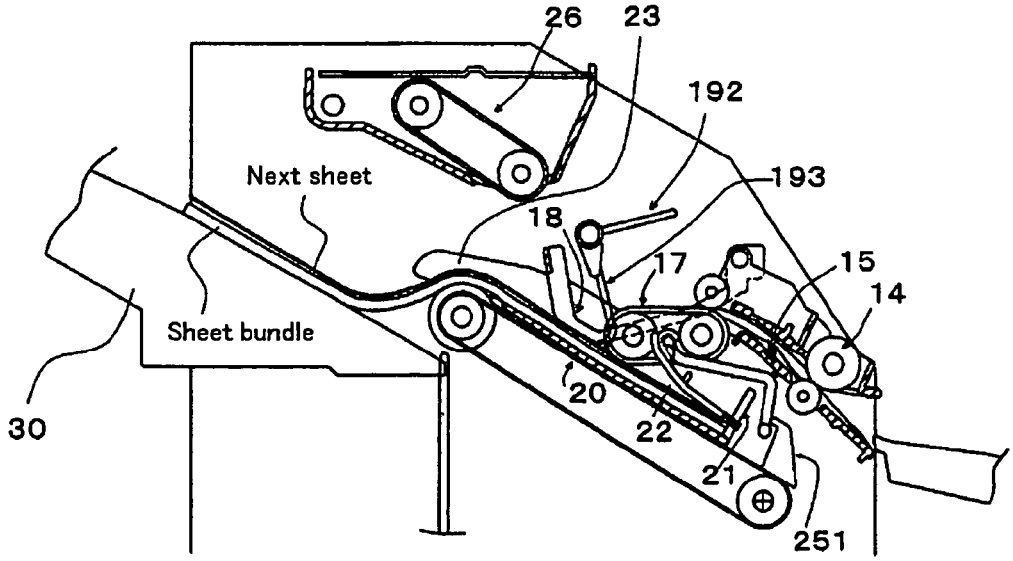
Figure 12I:
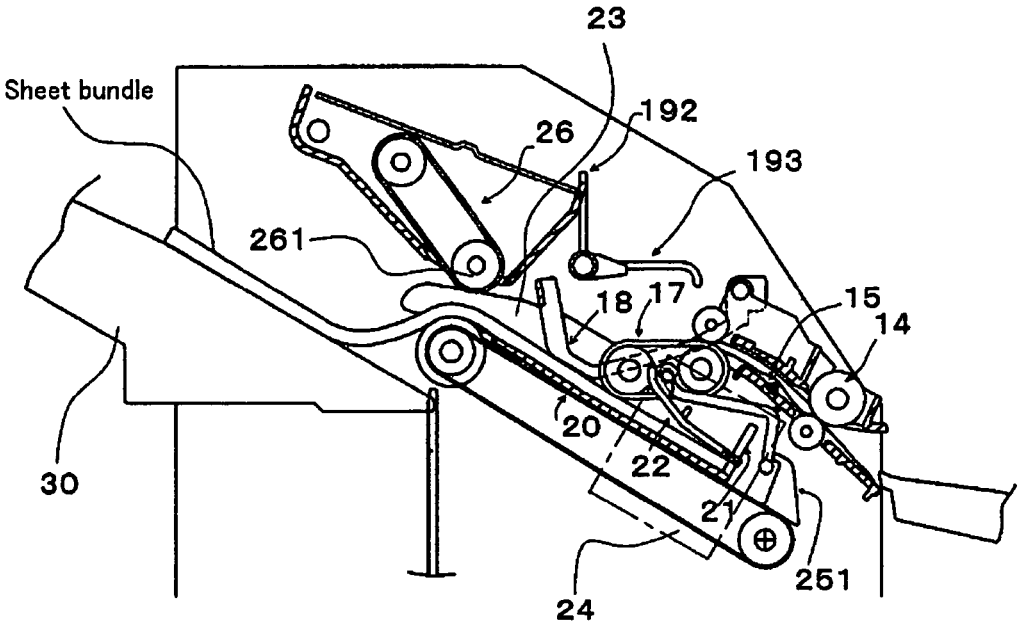
Figure 12J:
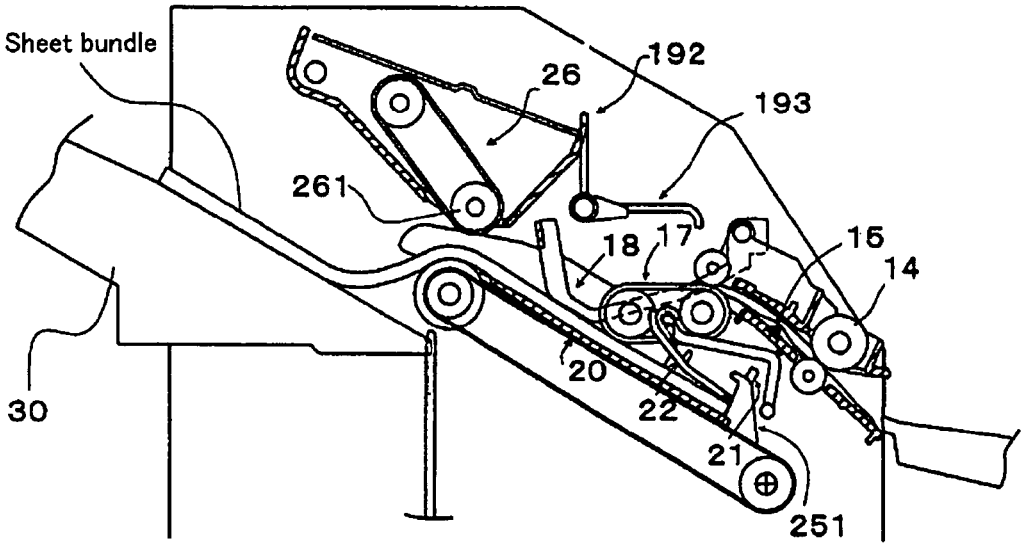
Figure 12K:
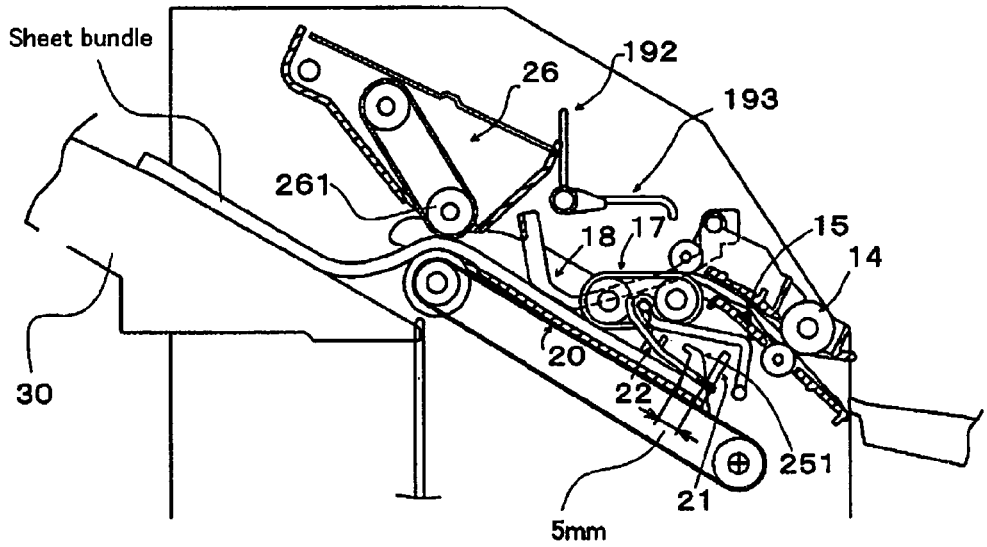
Figure 12L:
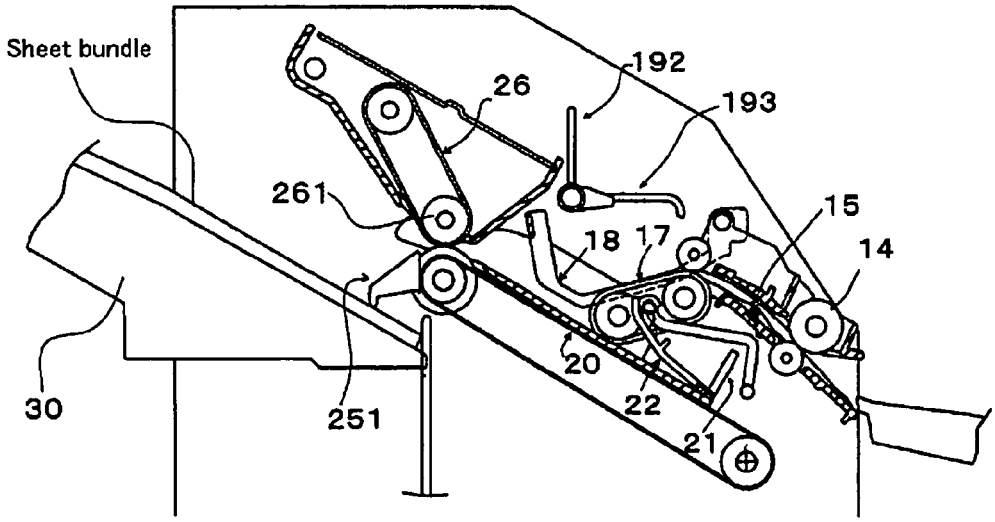
Figure 12M:
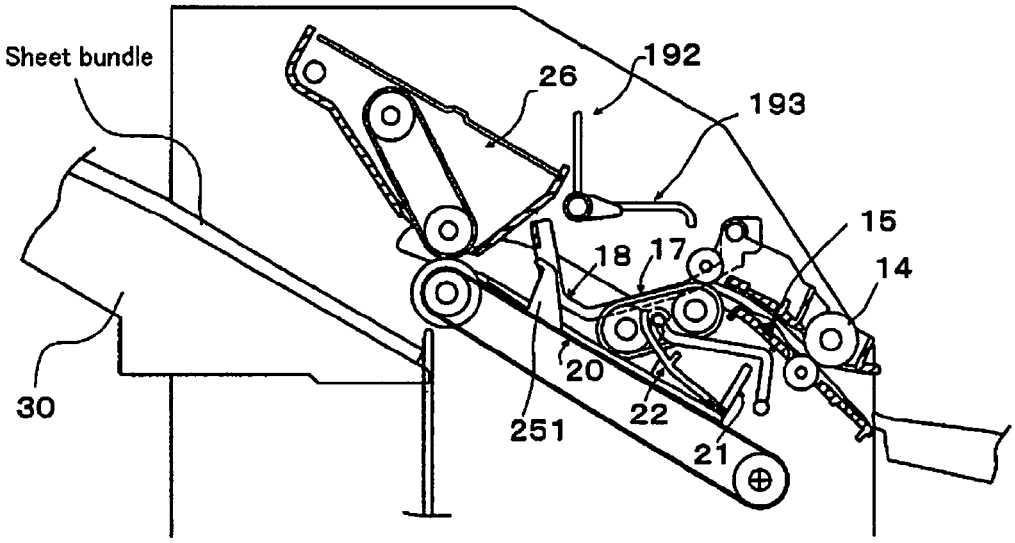
Figure 12N:
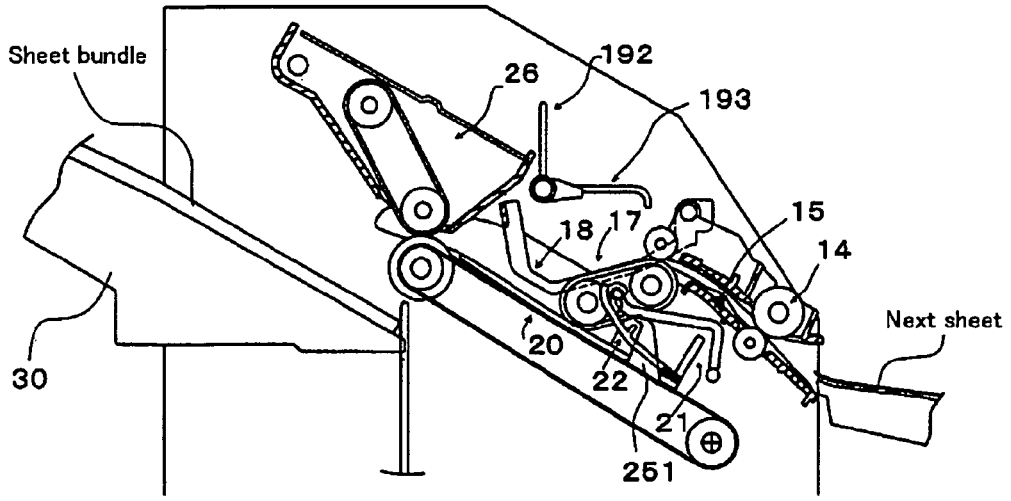
Figure 13A:
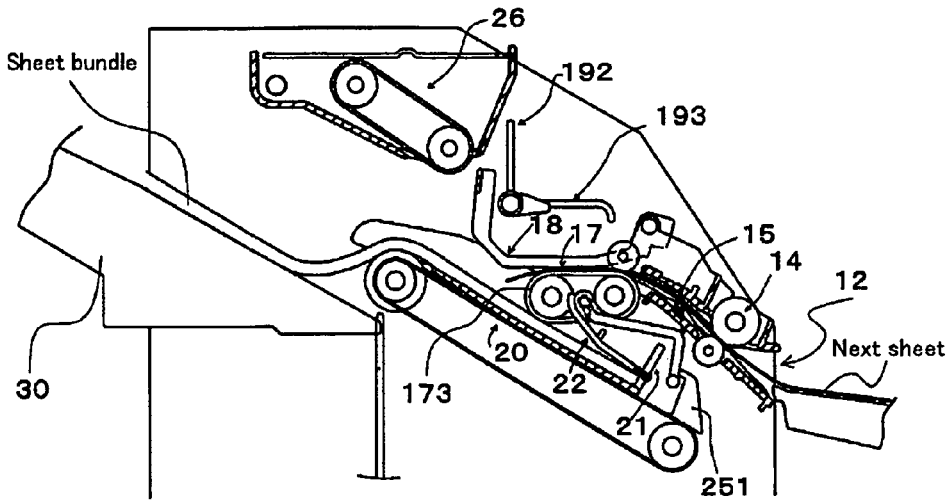
FIGS. 13(*a*) to 13(*h*) are diagrams illustrating the flow of operations performed by the postprocess apparatus in a "jog mode."
Figure 13B:
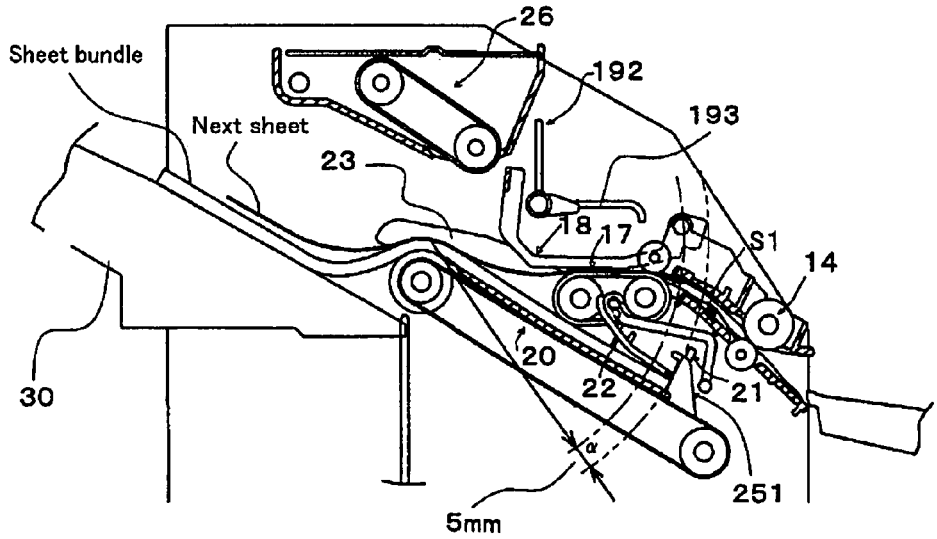
Figure 13C:
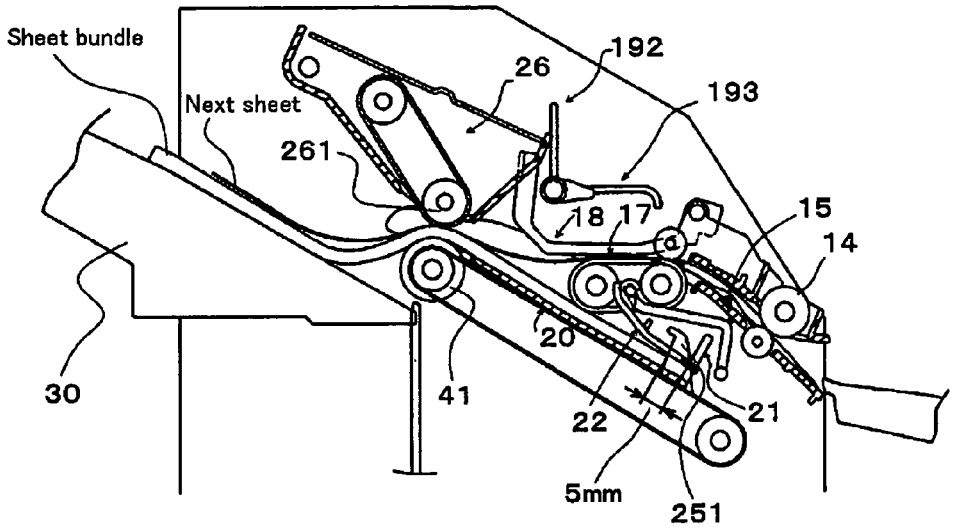
Figure 13D:
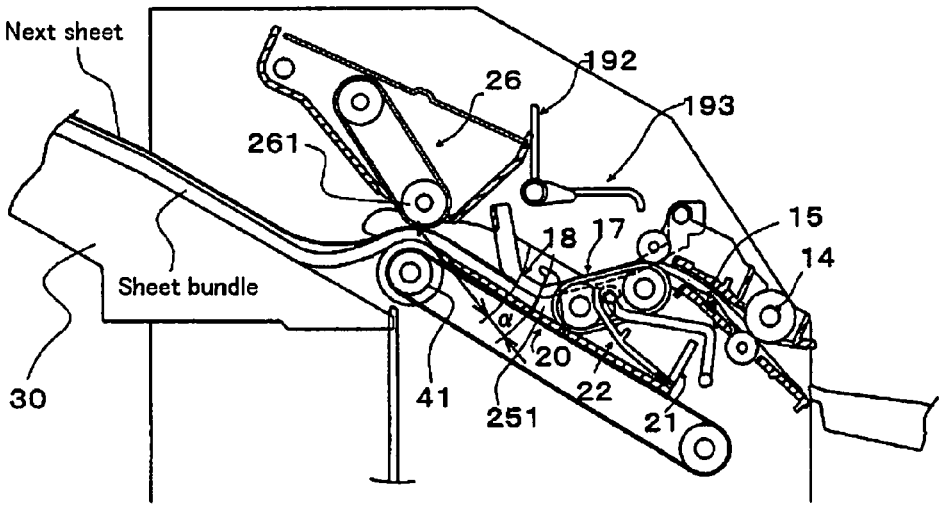
Figure 13E:
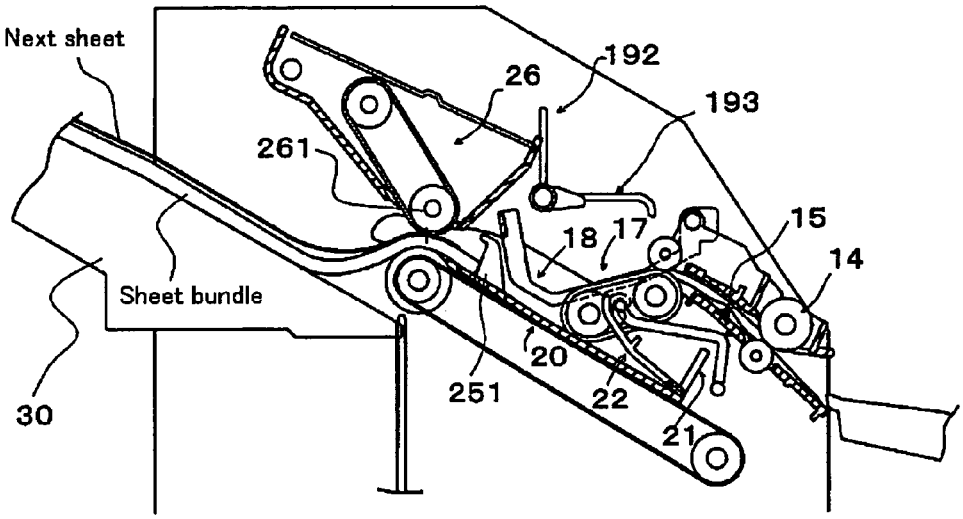
Figure 13F:
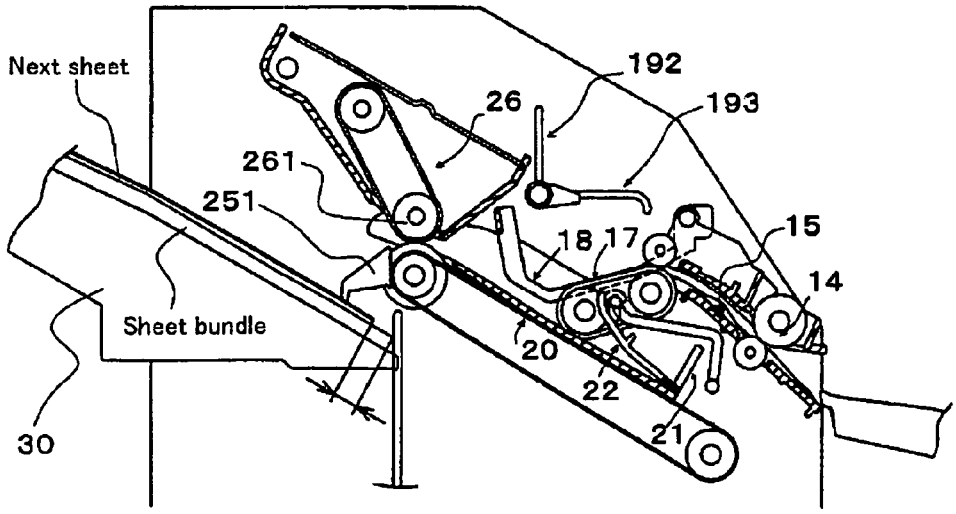
Figure 13G:
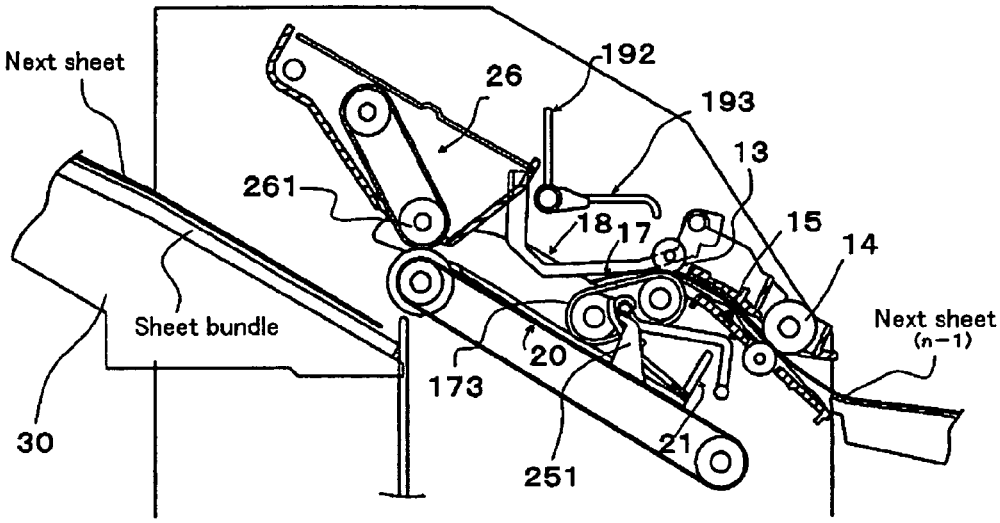
Figure 13H:
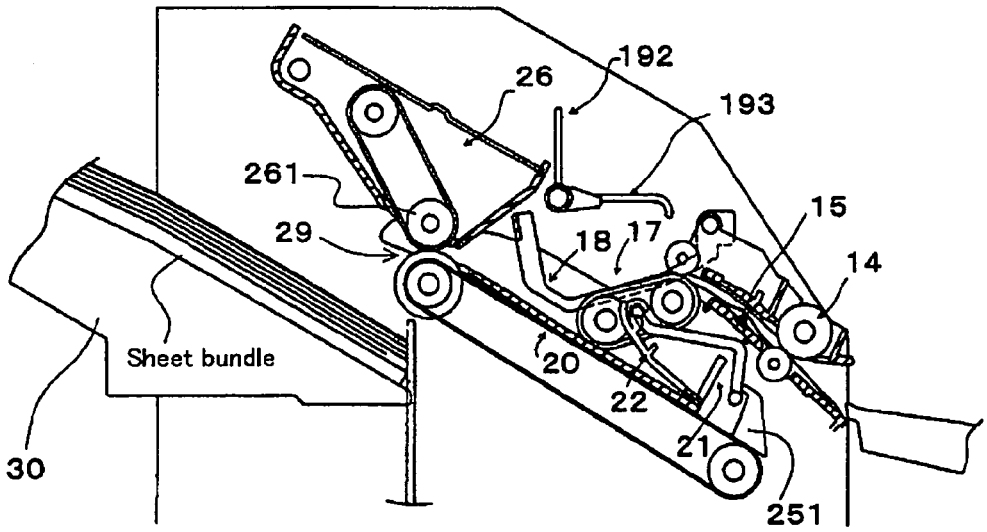

The illustrated embodiment also comprises another arrangement for a characteristic operation mode. As shown in FIG. 11, the eject roller means 26 and the push-out pawl 251 simultaneously convey a sheet (sheet 1 in the figure) stacked on the process sheet and a succeeding sheet (sheet 2 in the figure) conveyed from the sheet discharging port 13. In this case, actuation timings for the eject roller means 26 and push-out pawl 251 are set so that the trailing end S21 of the succeeding sheet (sheet 2) is offset from the trailing end S11 of the preceding sheet by a distance $\alpha$ in the figure so as to locate the trailing end S21 of the succeeding sheet (sheet 2) ahead of the trailing end S11 of the preceding sheet. The relationship $\beta>\alpha$ is established between the amount of the offset ($\alpha$ in the figure) formed in the conveying direction and the length ($\beta$ in the figure) between the trailing end of the stacked sheets and the first position of the stacking tray 30 contacted by the sheet leading end upon entering the stacking tray 30.

This prevents the offset sheet from being pushed out by the leading end of the succeeding sheet as a result of too large an offset amount which may cause the sheet leading end to come into contact with the stacking tray 30 at a point beyond the appropriate one. The trailing end S21 of the succeeding sheet is prevented from being damaged by the push-out pawl 251, by thus offsetting the trailing end S11 of the preceding sheet from the trailing end S21 of the succeeding sheet by the predetermined amount.

The operation modes will now be described. The above apparatus comprises the "sheet binding process" and "jog process" operation modes, which will be sequentially described.

Sheet Binding Mode

A series of sheets conveyed from the image forming apparatus are sequentially stacked, via the sheet discharging port 13, on the process tray in the order of pages and aligned with one another. A postprocess such as stapling is then executed on the sheet trailing edge. The processed sheet bundle is housed in the stacking tray 30 by the eject roller means 26. This operation is shown in FIGS. 12(*a*) to 12(*c*).

FIG. 12(*a*) shows that a bundle of sheets has been placed on the process tray 20. The apparatus receives, from the image forming apparatus, a signal indicating that a sheet will be conveyed from the image forming apparatus. The conveyance driving motor M1 is then driven to rotate the conveying roller 14. When the inlet sensor 15 detects the sheet leading end, the control CPU actuates the solenoid SL2 to rotate the cam 58. The eject roller means 26 moves from the operative position shown in FIG. 12(*a*) to the withdrawn position shown in FIG. 12(*b*), in which it is then held. The driving motor M1 is then rotated to advance the sheet between the caterpillar belt 173 and the pinch roller 177 as shown in FIG. 12(*c*). Once the sheet leading end reaches a predetermined position on the caterpillar belt 173, the solenoid SL1 is actuated to start rotating the paddle piece 192. An actuation timing for the solenoid SL1 is set by a timer on the basis of a signal given by the inlet sensor 15 and indicating detection of the sheet leading end.

Simultaneously with the rotation of the paddle piece 193, the pressurizing elastic piece 192 depresses the leading end 181 of the guide plate 18 as shown in FIG. 12(*d*). The guide plate 18 is thus gradually pressed against the belt top surface 173*a*. Immediately before the sheet trailing end leaves the caterpillar belt 173, the pressurizing elastic piece 192 presses the guide plate 18 as shown in FIG. 12(*e*) This allows the sheet trailing end to rush out from the caterpillar belt 173 and to reliably reach the process tray 20 even if the sheet is thick paper.

The sheet having thus reached the process tray 20 is conveyed in the reverse direction by the paddle piece 193 as shown in FIG. 12(*f*). The sheet is then switched back and conveyed to the regulating member 21 by the belt bottom surface 173*b* as shown in FIG. 12(*g*). When the sheet trailing end is abutted against the regulating member 21 as shown in FIG. 12(*h*), the aligning means 23 aligns the sheet width direction. The operation in FIGS. 12(*a*) to 12(*h*) is repeated to stack predetermined sheets on the process tray 20.

After the predetermined sheets are stacked on the process tray 20, the apparatus receives a signal instructing a postprocess to be executed, from the image forming apparatus, to perform a postprocess operation. In the postprocess operation, the eject means 26 is moved to the standby position on the process tray 20 in the previously described manner. After the postprocess operation is performed, the processed sheets are conveyed from the process tray 20 to the stacking tray 30. This operation drives the sheet push-out pawl driving motor M2 to move the push-out pawl 251 to the position where it engages with the sheet trailing end as shown in FIG. 12(*j*). On this occasion, the eject roller means 26 is placed away from the sheet.

Then, with the sheet slightly moved (in the figure, about 5 mm) by the push-out pawl 251, the bundled sheets are simultaneously conveyed toward the stacking tray 30 at the same speed by the push-out pawl 251 and eject rollers 261. The push-out pawl 251 conveys the sheet before the eject rollers 261 do, so that the eject rollers 261 come into contact with the sheet before the push-out pawl 251 does. This prevents the bundled sheets from coming loose. The sheet bundle is thus discharged to the stacking tray 30 (see FIG. 12(*l*)). After this operation, the push-out pawl 251 reverses the sheet push-out pawl driving motor M2 to return it to its home position as shown in FIG. 12(*n*) to provide for the next sheet conveyance. Control is then performed so that while the push-out pawl 251 is returning, the succeeding sheet starts to be conveyed as shown in FIG. 12(*n*).

Description of the Jog Mode

A series of sheets conveyed from the image forming apparatus are classified and housed in the stacking tray 30 so as to be rearranged in the order of pages. The process tray 20 comprises a shift mechanism that shifts the sheets by a predetermined amount in a direction orthogonal to the conveying direction. Control is performed as follows. The sheets from the image forming apparatus are sequentially conveyed by the operation described in FIGS. 12(*a*) to 12(*h*). With reference to FIG. 13, description will be given of the jog operation of rearranging and classifying the sheets in the order of pages.

FIG. 13(*a*) shows that the sheet leading end is conveyed from the conveying port 12 to the caterpillar belt 17 by the conveying roller 14. FIG. 13(*b*) shows a timing for starting the operation in which the preceding sheet is discharged to the stacking tray 30 by the sheet push-out means 25. With the trailing end of the succeeding sheet positioned at the sheet discharging port 13 and the push-out pawl 251 engaged with the trailing end of the preceding sheet bundle, the trailing end of the succeeding sheet precedes the trailing end of the preceding sheet bundle by $\alpha$=5 mm. The preceding sheet bundle has been moved a predetermined amount on the process tray 20 across the width by the aligning means 23. When the succeeding sheet is conveyed by the caterpillar belt 173, the paddle piece 192 is held in its initial position and remains inoperative.

Once the push-out pawl 251 moves 5 mm in the discharging direction as shown in FIG. 13(*c*), the eject rollers 261 are lowered to the lowest position. The succeeding sheet and the sheet bundle are then discharged so as to overlap. On this occasion, the pinch roller 41 is located to prevent the sheet from leaving until the eject rollers 261 nip the succeeding sheet. FIG. 13(*d*) shows that the trailing ends of the two successive sheets overlap on the process tray 20. As is apparent from the drawing, the trailing end of the succeeding sheet precedes the trailing end of the preceding sheet by the predetermined amount ($\alpha$), with the predetermined spacing created between the trailing end and the push-out pawl 251. With the trailing end of the succeeding sheet preceding the trailing end of the sheet bundle by the predetermined amount ($\alpha$) in the discharging direction, the sheet bundle is discharged to the stacking tray 30 by the pawl member 251 and eject rollers 261.

FIG. 13(*e*) shows that the succeeding sheet is discharged by the push-out pawl 251 and eject rollers 261 so as to be offset forward from the preceding sheet by the predetermined amount (α). On this occasion, the push-out pawl 251 passes by the side of the eject rollers 261. FIG. 13(*f*) shows that the push-out pawl 251 has passed by the side of the eject rollers 261 and that the overlapping succeeding sheet and sheet bundle are discharged. FIG. 13(*g*) shows that the overlapping successive sheets are housed in the stacking tray 30. On this occasion, further succeeding sheets are sequentially discharged from the sheet discharging port 13. As shown in the figure, one of the succeeding sheets has its leading end fed to the caterpillar belt 173 and is then fed to the eject roller means 26 by the caterpillar belt 173. Once the sheet bundle push-out pawl 251 is positioned upstream of the caterpillar belt 173 in the discharging direction (withdrawn position), the next succeeding sheet (n-1) starts to be conveyed and is then discharged to the stacking tray 30 by the eject rollers 261. The push-out pawl 251 returns to its home position and stands by until the third sheet is transferred.

FIG. 13(*h*) shows that the trailing end of the succeeding sheet has been transferred to the stacking tray 30. As shown in the figure, the succeeding sheet engages with the sheets on the stacking tray 30 at an illustrated position X determined by the spacing between the eject port 29 and the stacking tray 30 and the inclination of the tray. The offset spacing (α) is set smaller than the illustrated spacing β. Once all of the group of succeeding sheets has been discharged and if the third sheet is to be classified, the process returns to the operation described with reference to FIG. 12(*b*). When the conveyed sheet is detected by the inlet sensor 15, the eject roller means 26 moves to the withdrawn position. If the third and subsequent sheets need not be classified, the operation is finished.

The disclosures of Japanese Patent Application Nos. 2005-73470, 2005-73471, 2005-73472, and 2005-73473, all of which were filed on Mar. 15, 2005, are incorporated herein.

What is claimed is:

1. A sheet postprocess apparatus comprising:

a sheet discharging device, said sheet discharging device comprising:

a sheet discharging port from which sheets are sequentially conveyed;

a process tray provided below the sheet discharging port and on which the sheets are stacked and supported; and a switchback transferring device provided between the sheet discharging port and the tray to convey each sheet from the sheet discharging port to the tray and then to reverse a conveying direction of the sheet on the tray to transfer the sheet to a predetermined position, the switchback transferring device comprising:

a conveying belt provided between the sheet discharging port and the tray, the conveying belt having a tray-side end and a sheet discharging port-side end, a roller cooperating with the conveying belt to transfer the sheet from the sheet discharging port onto the conveying belt, a plate shape guide member located opposite a belt surface of the conveying belt at a downstream side of the roller in a sheet discharge direction to convey the sheet from the sheet discharging port to the tray, the plate shape guide member extending along the conveyer belt and comprising a tray-side end and a sheet discharging port-side end, and a pressing force applicator for depressing the plate shape guide member toward the conveying belt, the conveying belt and the guide member being arranged so that the tray-side end of each of the conveying belt and the guide member can pivot around its sheet discharging port-side end in a vertical direction;

a postprocessor located at the process tray to execute a postprocess on a sheet bundle;

a stacking tray located downstream of the process tray;

a paddle transfer device located above the process tray near the switchback transfer device to transfer the sheet on the process tray to a postprocess position; and a driver for driving the paddle transfer device, the pressing force applicator being actuated by the paddle transfer device.

2. The sheet postprocess apparatus according to claim 1, wherein the postprocessor is at least one of a device for binding, punching, and stamping the sheets.

3. The sheet postprocess apparatus according to claim 1, further comprising:

a roller conveyor located at a sheet conveyance end of the process tray so as to be movable between an operative position at which the roller conveyor engages a sheet on the process tray, and a withdrawn position at which the roller conveyor is separated from the sheet; and a sheet push-out device located so as to be movable along the process tray, the sheet push-out device being capable of engaging a trailing edge of the sheet to push out and convey the sheet, the roller conveyor being located at a distance less than a length of a minimum sized sheet as measured from a sheet trailing end reference position on the process tray, and the sheet push-out device being located so as to be movable along the process tray from the sheet trailing end reference position to the sheet conveyance end so that a sheet bundle is conveyed from the reference position on the process tray to the stacking tray by cooperation of the roller conveyor and the sheet push-out device.

4. The sheet postprocess apparatus according to claim 3, wherein the sheet push-out device comprises a belt member extended between a pair of pulleys, and a projecting member provided on the belt member to engage with the trailing edge of the sheet, and the roller conveyor is configured to be capable of coming into pressure contact with, and then separating from, a fixed roller rotatably attached to a rotating shaft of the one of the pulleys positioned on a sheet conveying side.

5. The sheet postprocess apparatus according to claim 3, wherein each of the roller conveyor and the sheet push-out device comprises a driver, and after the sheet bundle is transferred by a predetermined amount from the reference position on the process tray by the sheet push-out device, the roller conveyor is capable of applying a conveying force to the sheet bundle to convey the sheet bundle to the stacking tray.

6. The sheet postprocess apparatus according to claim 3, wherein the sheet push-out device comprises at least two projecting members spaced from each other in a direction orthogonal to the sheet conveying direction, with two pinch rollers arranged between the two projecting members, and the roller conveyor comprises two driving rollers capable of engaging with the pinch rollers.

7. The sheet postprocess apparatus according to claim 6, wherein the two driving rollers are supported by a bracket member attached to a shaft capable of being rotatably driven, and the bracket member is pivotable across the sheet width and abuts the driving rollers against the sheets on the process tray under a substantially uniform pressure contact force.

8. The sheet postprocess apparatus according to claim 3, wherein the roller conveyor is movable among a withdrawn position at which the roller conveyor is separate from the sheet on the process tray, a standby position at which the roller conveyor is close to the sheet, and an operative position at which the roller conveyor contacts the sheet so that the roller conveyor is located in the withdrawn position while the sheet is being conveyed to the process tray, located in the standby position while a postprocess is being executed on the sheet on the process tray, and located in the operative position to convey the sheet from the process tray to the stacking tray.

9. The sheet postprocess apparatus according to claim 3, wherein the sheet push-out device is capable of reciprocating along the process tray between a start point located upstream of the sheet trailing end reference position and an end point located downstream of the conveyance end where the roller conveyor is positioned.

10. The sheet postprocess apparatus according to claim 1, further comprising:

a regulator provided on the process tray for positioning and regulating an edge of a sheet from the sheet discharging port; and a sheet presser for pressing and guiding a leading end of the sheet moved on the process tray by the paddle transfer device, the sheet presser comprising a guide member for pressing and guiding the leading end of the sheet moved on the process tray, and an arm member for pivotably supporting the guide member, the guide member having a first turning supporting point, a second turning supporting point, a base end positioned upstream in the conveying direction and supported by the arm member so as to be rotatable around the first turning supporting point, and a leading end inclined so as to abut against the sheets on the tray, and the arm member having its sheet conveying direction downstream side turnably supported at the second turning supporting point so that the first turning supporting point of the guide member moves in a vertical direction depending on a quantity of stacked sheets.

11. A sheet postprocess apparatus comprising:

a sheet discharging device comprising: a sheet discharging port from which sheets are sequentially conveyed; a process tray provided below the sheet discharging port and on which the sheets are stacked and supported; and a switchback transferring device provided between the sheet discharging port and the tray to convey each sheet from the sheet discharging port to the tray and then to reverse a conveying direction of the sheet on the tray to transfer the sheet to a predetermined position, the switchback transferring device comprising: a conveying belt provided between the sheet discharging port and the tray, the conveying belt having a tray-side end and a sheet discharging port-side end, and a guide member located opposite a belt surface of the conveying belt to convey the sheet from the sheet discharging port of the conveying belt to the tray, the guide member having a tray-side end and a sheet discharging port-side end, and a pressing force applicator for depressing the guide member toward the conveying belt, wherein the conveying belt and the guide member are arranged so that the tray-side end of each of the conveying belt and the guide member can pivot around its sheet discharging port-side end in a vertical direction;

a postprocessor located at the process tray to execute a postprocess on a sheet bundle;

a stacking tray located downstream of the process tray;

a paddle transfer device located above the process tray near the switchback transfer device to transfer the sheet on the process tray to the postprocess position; and a driver for driving the paddle transfer device, the pressing force applicator being actuated by the paddle transfer device, wherein the paddle transfer device has a first postprocess time for applying a conveying force to the sheet on the process tray, which is different from a second postprocess time at which the pressing force applicator applies a pressing force to the guide member.

12. The sheet postprocess apparatus according to claim 11, wherein the paddle transfer device comprises a first elastic piece having a base end fixed to a rotating shaft, and a leading end, the leading end being elastically deformed so as to convey the sheet on the process tray, and the pressing force applicator comprises a second elastic piece fixed to the rotating shaft, a leading end of the second elastic piece being capable of abutting against the guide member so as to be deformed and apply the pressing force.

13. The sheet postprocess apparatus according to claim 12, wherein the first and second elastic pieces are attached to the rotating shaft so that after the second elastic piece applies the pressing force to the guide member, the first elastic piece conveys the sheet on the process tray.

* * * * *